US010322841B2

(12) United States Patent
Dahan

(10) Patent No.: US 10,322,841 B2
(45) Date of Patent: Jun. 18, 2019

(54) DUAL SPOUT AND DUAL CHAMBER CARTON

(71) Applicant: Giyora Dahan, Tarzana, CA (US)

(72) Inventor: Giyora Dahan, Tarzana, CA (US)

( * ) Notice: Subject to any disclaimer, the term of this patent is extended or adjusted under 35 U.S.C. 154(b) by 0 days.

(21) Appl. No.: 16/010,308

(22) Filed: Jun. 15, 2018

(65) Prior Publication Data

US 2019/0047744 A1 Feb. 14, 2019

Related U.S. Application Data

(63) Continuation-in-part of application No. 29/613,845, filed on Aug. 14, 2017.

(60) Provisional application No. 62/549,332, filed on Aug. 23, 2017, provisional application No. 62/660,892, filed on Apr. 20, 2018.

(51) Int. Cl.

| | |
|---|---|
| ***B65D 5/48*** | (2006.01) |
| ***B65D 5/40*** | (2006.01) |
| ***B65D 5/74*** | (2006.01) |
| ***B65D 5/06*** | (2006.01) |
| ***B65D 81/32*** | (2006.01) |
| ***B65D 5/42*** | (2006.01) |

(52) U.S. Cl.

CPC ..... *B65D 5/48002* (2013.01); *B65D 5/067* (2013.01); *B65D 5/40* (2013.01); *B65D 5/4275* (2013.01); *B65D 5/48* (2013.01); *B65D 5/746* (2013.01); *B65D 81/3205* (2013.01); *B65D 81/3216* (2013.01)

(58) Field of Classification Search

CPC ..... B65D 5/48002; B65D 5/067; B65D 5/40; B65D 5/746; B65D 81/3205

USPC ..... 229/120.02, 120.01, 213; 220/505, 529; 222/94

See application file for complete search history.

(56) References Cited

U.S. PATENT DOCUMENTS

| | | | |
|---|---|---|---|
| 132,020 | A | 10/1872 | Odell |
| 6,105,812 | A | 8/2000 | Riordan |
| 6,182,887 | B1 | 2/2001 | Ljunstrom |
| 6,220,311 | B1 | 4/2001 | Litto |

(Continued)

FOREIGN PATENT DOCUMENTS

| | | | |
|---|---|---|---|
| WO | WO2000030954 | A1 | 6/2000 |
| WO | WO2003057590 | A2 | 7/2003 |

(Continued)

*Primary Examiner* — Christopher R Demeree
(74) *Attorney, Agent, or Firm* — Eric Kelly

(57) ABSTRACT

A carton with dual, separate, and independent, but adjoining chambers is described; wherein each separate, independent, and adjoining chamber has its own respective spout and removably coupled lid to provide removable closure and access to the given chamber. Such cartons may be used in methods for removably housing (and/or dispensing) a first liquid edible item from a first-chamber and for removably housing (and/or dispensing) a second liquid edible item from a second-chamber. Together the first-chamber and the second-chamber may form the carton. External dimensions of such a carton may be standard. In some embodiments, the first liquid edible item and/or the second liquid edible item may be selected from one or more of: different types of beverages; different types of milks (1%, 2%, skim, whole, non-fat, chocolate, strawberry, and the like); different types of juices, and/or the like.

18 Claims, 19 Drawing Sheets

(56) References Cited

U.S. PATENT DOCUMENTS

| | | | | |
|---|---|---|---|---|
| 6,237,800 | B1 * | 5/2001 | Barrett | A01K 7/00 215/312 |
| 6,571,977 | B2 * | 6/2003 | Goncalez | B65D 1/04 215/6 |
| D499,651 | S * | 12/2004 | Gong | D9/738 |
| 6,913,777 | B2 | 7/2005 | Rebhorn | |
| 6,989,168 | B2 | 1/2006 | Fahey | |
| 7,124,914 | B2 | 10/2006 | Foster | |
| 7,331,478 | B2 | 2/2008 | Aljadi | |
| D614,951 | S * | 5/2010 | Daniels | D9/431 |
| 8,240,497 | B2 | 8/2012 | Kountotsis | |
| 8,746,475 | B2 * | 6/2014 | Kountotsis | B65D 23/10 215/396 |
| 2002/0110622 | A1 * | 8/2002 | Lloyd | B65D 1/04 426/115 |
| 2005/0109796 | A1 * | 5/2005 | Bourque | B65D 75/008 222/94 |
| 2007/0267416 | A1 | 11/2007 | Eichenbaum | |
| 2010/0237034 | A1 | 9/2010 | Kountotsis | |
| 2018/0009566 | A1 * | 1/2018 | Muhammad | B65D 5/48048 |

FOREIGN PATENT DOCUMENTS

| | | |
|---|---|---|
| WO | WO2012101100 | 8/2012 |
| WO | WO2012101100 A2 | 8/2012 |

* cited by examiner

DUAL SPOUT AND DUAL CHAMBER CARTON

PRIORITY NOTICE

The present application claims priority under 35 U.S.C. § 119(e) to U.S. Provisional Patent Application Ser. No. 62/549,332 filed on Aug. 23, 2017, and to U.S. Provisional Patent Application Ser. No. 62/660,892 filed on Apr. 20, 2018, the disclosures of which are incorporated herein by reference in its entirety.

The present application, a continuation-in-part application, claims priority under 35 U.S.C. § 120 to U.S. Non-provisional patent application Ser. No. 29/613,845 filed on Aug. 14, 2017, the disclosure of which is incorporated herein by reference in its entirety.

TECHNICAL FIELD OF THE INVENTION

The present invention relates in general to cartons and more specifically to cartons for holding liquids, such as beverages, wherein such cartons may have at least two chambers, with each such chambers having its own separate and independent spout.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Presently (circa 2018) gable topped cartons (or flat topped cartons), such as gable topped milk (or juice) cartons, only have one internal chamber; and thus, if different contents (e.g., a milk and a chocolate milk) were to be stored within that one internal chamber, those different contents would mix, which depending upon the contents or goals, may be undesirable.

There is a need in the art for a single gable topped carton that has at least two internal chambers, wherein these two internal chambers are separate and independent from each other, wherein each such chamber may have its own access point, e.g., its own spout; such that different contents of the given internal chambers may be removably housed and/or dispensed from a single carton, but removably housed, without mixing, at least until dispensed.

And/or there is a need in the art for a single substantially flat topped carton that has at least two internal chambers, wherein these two internal chambers are separate and independent from each other, wherein each such chamber may have its own access point, e.g., its own spout; such that different contents of the given internal chambers may be removably housed and/or dispensed from a single carton, but removably housed, without mixing, at least until dispensed.

Additionally, marketers often desire to get new product samples (e.g., a new beverage flavor) tried and tested by a particular target market (e.g., consumers). However, getting such new product samples to be tried is often expensive and difficult to achieve. It would be desirable to provide a smaller sample container/chamber that is connected to a container with a larger chamber than the smaller sample chamber, wherein the overall exterior dimensions of this dual chambered carton are standardized and/or typical (e.g., standardized sizing present in the marketplace), such as a standard sized gable-topped carton or such as standard sized flat topped carton; which would allow the sample to be marketed conveniently with the dual chambered carton with overall exterior dimensions that are standardized. Thus, pre-existing shelving and storage for standard sized cartons could be readily used to store such dual chambered (smaller sample chamber and larger chamber).

It is to these ends that the present invention has been developed.

BRIEF SUMMARY OF THE INVENTION

To minimize the limitations in the prior art, and to minimize other limitations that will be apparent upon reading and understanding the present specification, embodiments of the present invention may describe a carton (gabled topped in some embodiments or substantially flat in other embodiments) with dual, separate, and independent, but adjoining chambers (for holding different contents). In some embodiments, each separate, independent, and adjoining chamber may have its own respective spout and removably coupled lid to provide removable closure and access to the given chamber. Such cartons may be used in methods for removably housing (and/or dispensing) a first liquid edible item in a first-chamber and for removably housing (and/or dispensing) a second liquid edible item in a second-chamber. (Note, use of "edible" herein may mean something that may be safely drinkable, e.g., a beverage.) In some embodiments, the first liquid edible item and/or the second liquid edible item may be selected from one or more of: different types of beverages; different types of milks (1%, 2%, skim, whole, non-fat, chocolate, strawberry, and the like); different types of juices; different types of liquid concentrates; and/or the like.

It is an objective of the present invention to provide a carton with dual chambers that are adjoined, but separate and independent from each other.

It is another objective of the present invention to provide a carton with dual chambers, wherein access to each respective chamber may be via its own spout, with its own removably coupled lid.

It is another objective of the present invention to provide a carton that has a gable top structure and look to the carton.

It is another objective of the present invention to provide a carton that has a substantially flat top structure and look to the carton.

It is another objective of the present invention to provide a dual chambered carton whose overall external dimensions and shape is that of a standard sized carton.

It is another objective of the present invention to provide a dual chambered carton wherein one chamber is larger and one chamber is smaller.

It is yet another objective of the present invention to provide a dual chambered carton wherein one chamber is larger and one chamber is smaller; and wherein the smaller chamber may be used for marketing and/or distributing samples (e.g., as in a new flavor to be tried).

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

FIG. 6 may show the smaller-chamber without the larger-chamber.

FIG. 8 may show the smaller-chamber without the larger-chamber FIG. 9. may depict a carton with two internal adjoining but separate chambers, a larger-chamber and a smaller-chamber, shown from a perspective view and with partial transparency.

REFERENCE NUMERAL SCHEDULE

Figure 1A:
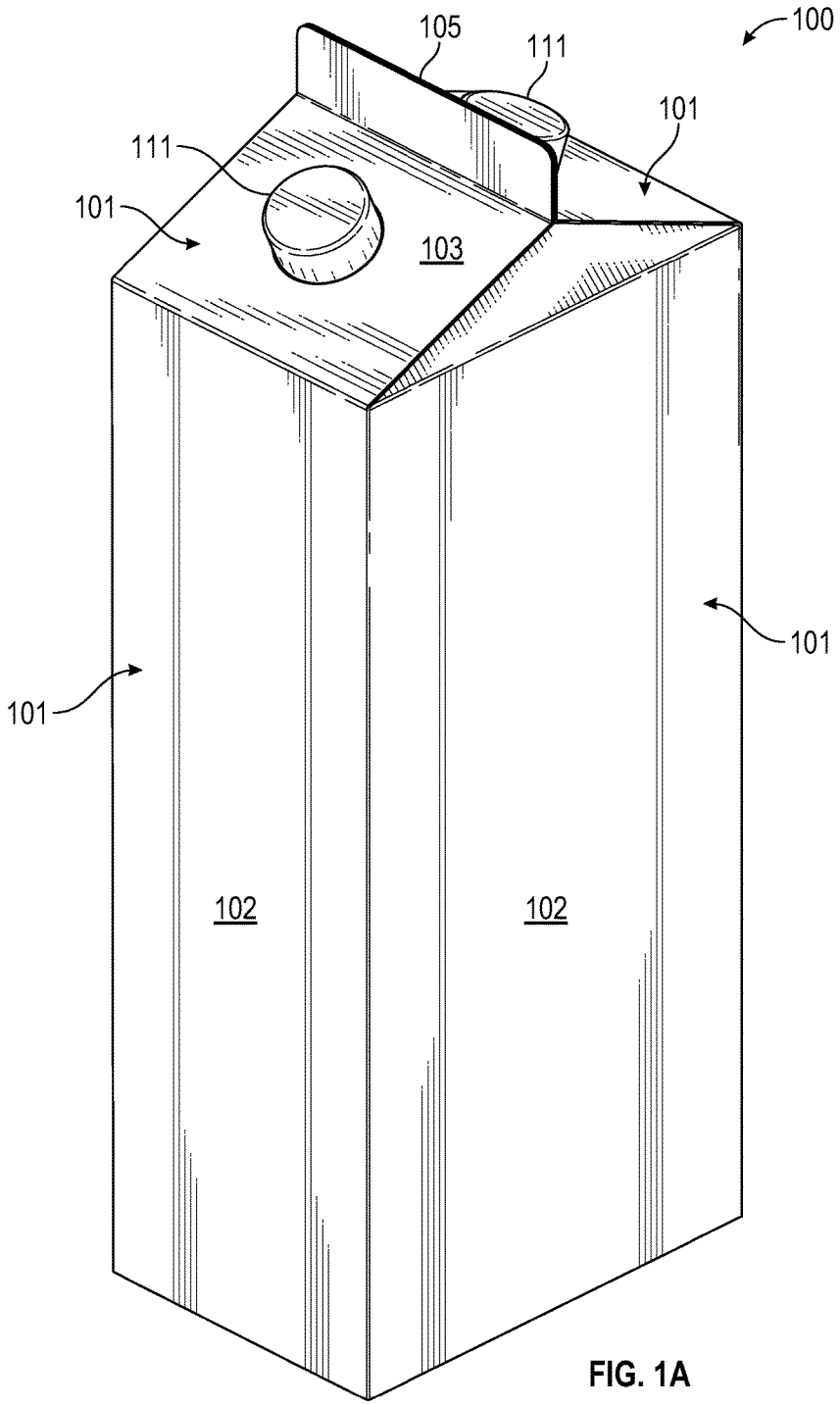
FIG. 1A may depict a perspective view of a carton, according to one embodiment of the present invention.

100 carton 100
101 exterior-walls 101
102 vertical-walls 102
103 top-walls 103
104 bottom-wall 104
105 gable-top 105
111 lid 111
201 first-chamber 201
202 second-chamber 202
203 common-interior-wall 203
211 first-chamber-width 211
212 second-chamber-width 212
303 common-interior-wall 303
411 spout 411
500 carton 500
501 larger-chamber 501
503 smaller-chamber 503
505 shared-internal-wall 505
507 smaller-chamber-bottom 507
509 smaller-chamber-bottom 509
600 carton 600
700 carton 700
701 larger-chamber 701
702 vertical-wall 702
703 smaller-chamber 703
705 internal-wall 705
706 mating-internal-wall 706
707 smaller-chamber-bottom 707
708 supportive-floor 708
711 fastener 711
800 carton 800
801 larger-chamber 801
802 vertical-wall 802
803 top-wall 803
810 hole 810
811 lid 811
813 smaller-chamber 813
900 carton 900
901 exterior-wall 901
902 vertical-wall 902
903 top-wall 903
904 vertical-wall 904 (of smaller-chamber 923)
905 top-wall 905 (of smaller-chamber 923)
909 chambers-vertical-boundary 909
910 hole 910
911 lid 911
921 larger-chamber 921
923 smaller-chamber 923

DETAILED DESCRIPTION OF THE INVENTION

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

Figure 1B:
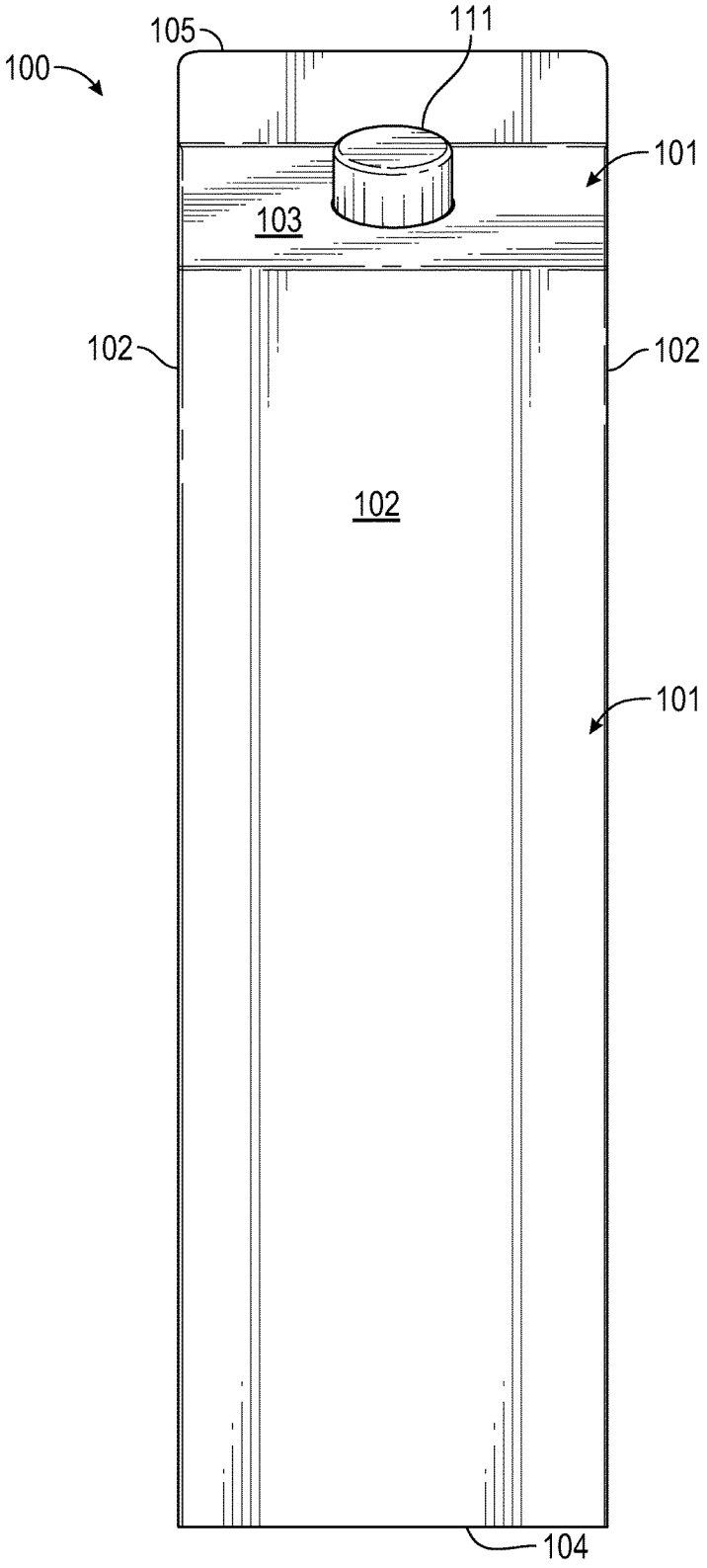
FIG. 1B may depict a front view of the carton of FIG. 1A.
Figure 1C:
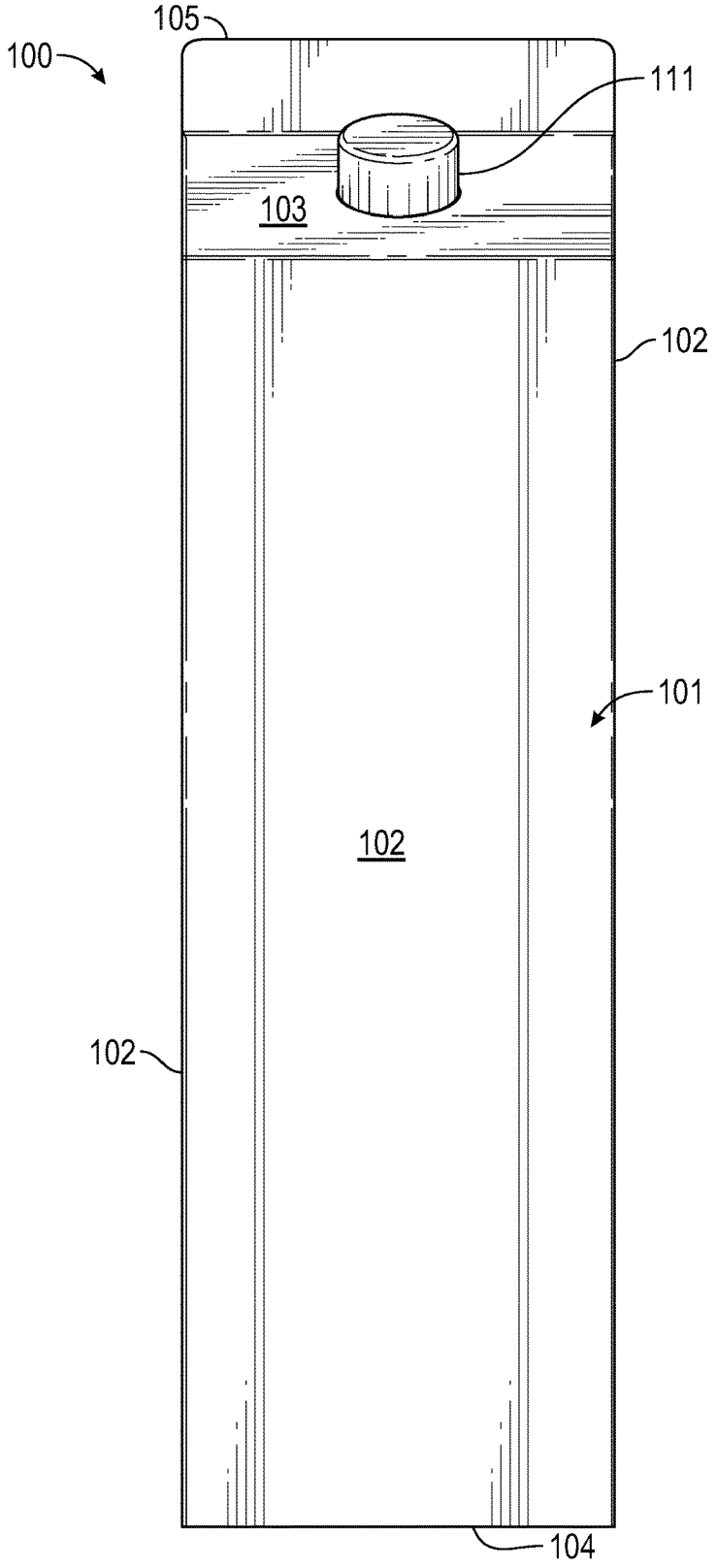
FIG. 1C may depict a back view of the carton of FIG. 1A.
Figure 1D:
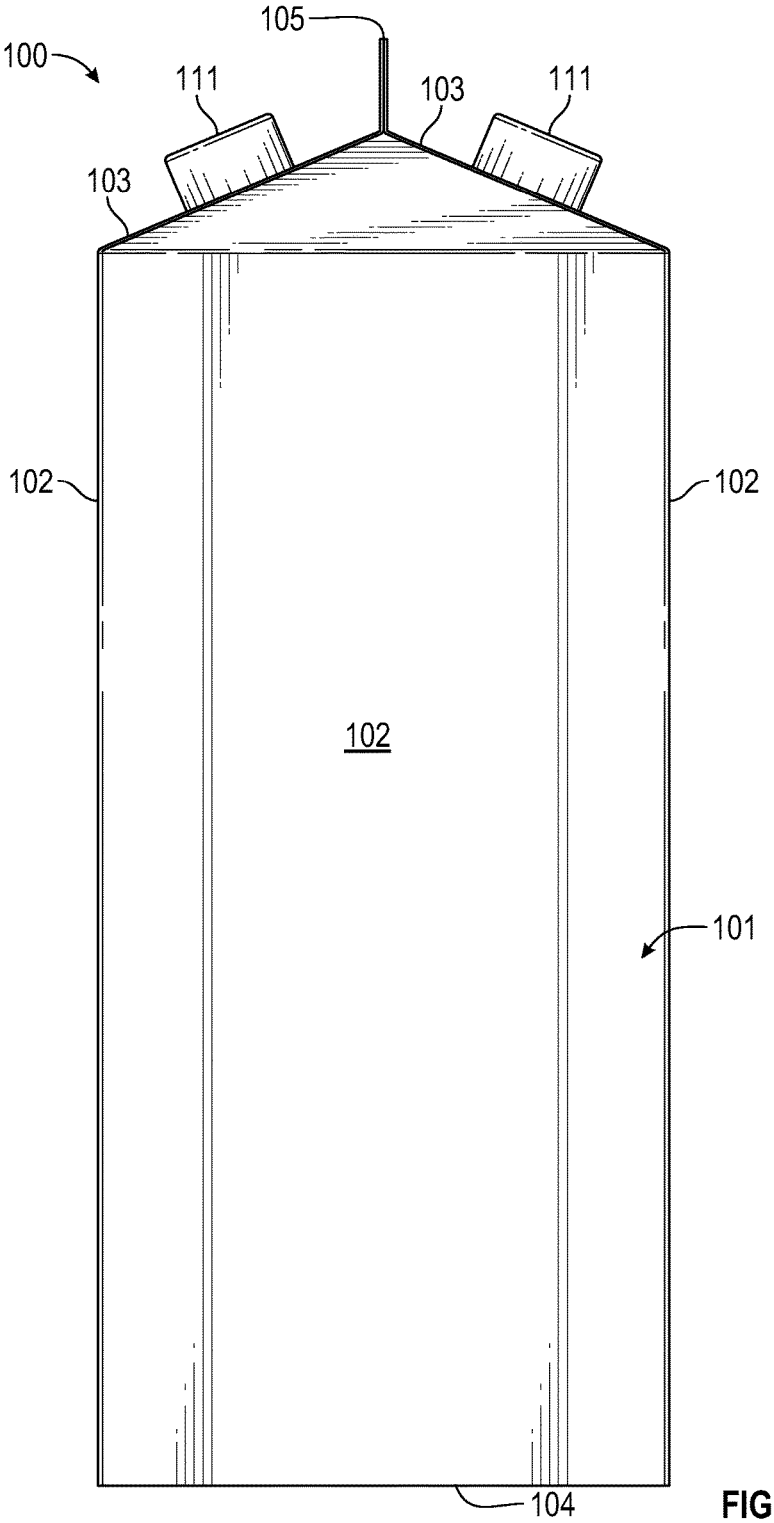
FIG. 1D may depict a left-side view of the carton of FIG. 1A.
Figure 1E:
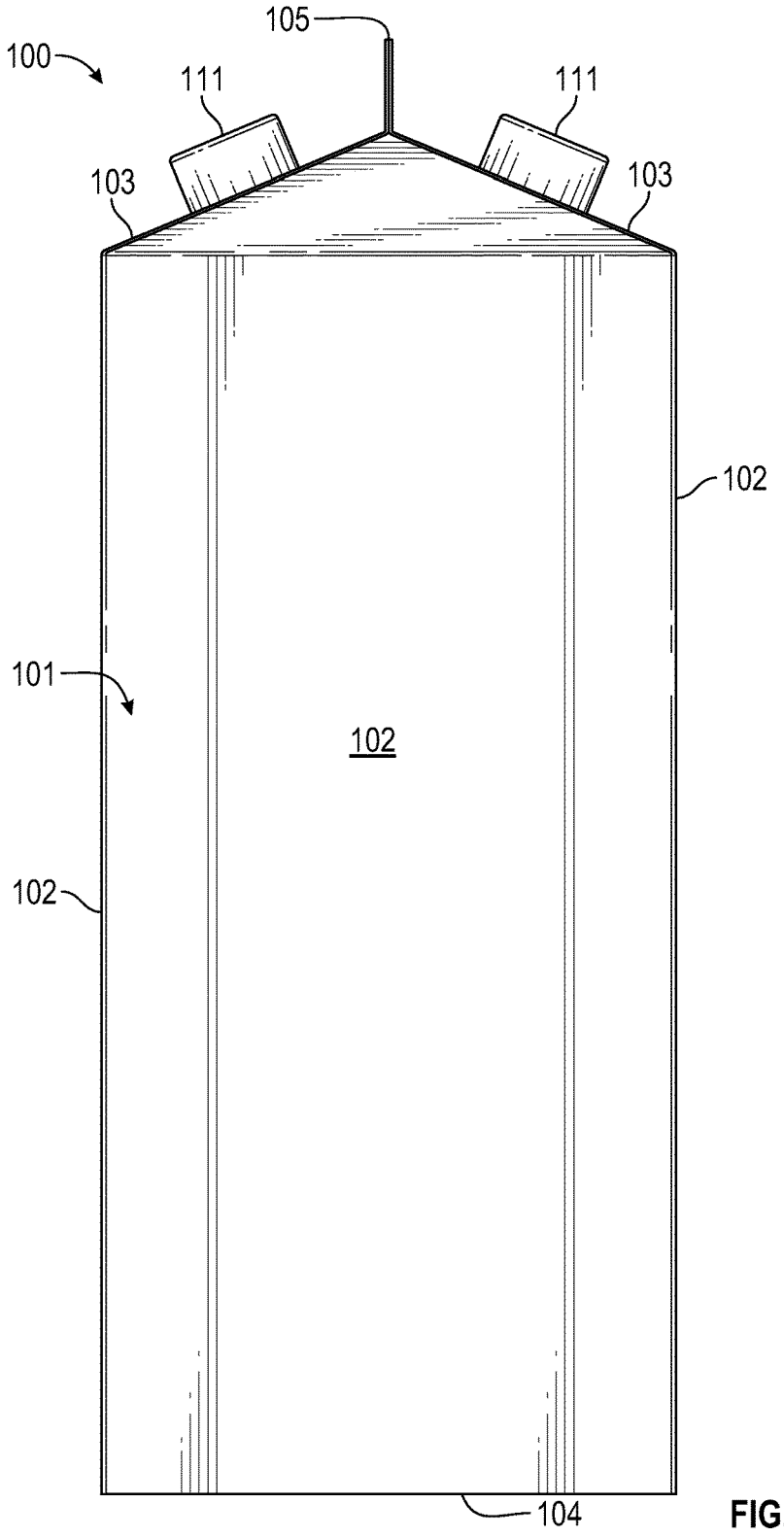
FIG. 1E may depict a right-side view of the carton of FIG. 1A.
Figure 1F:
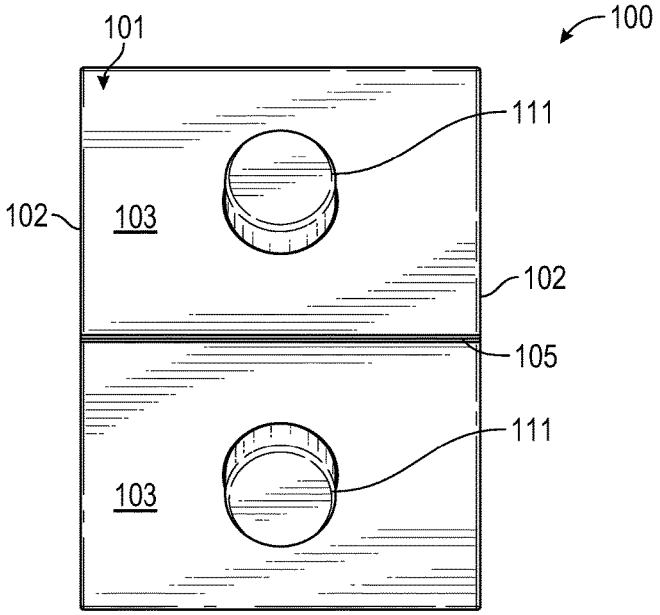
FIG. 1F may depict a top view of the carton of FIG. 1A.
Figure 1G:
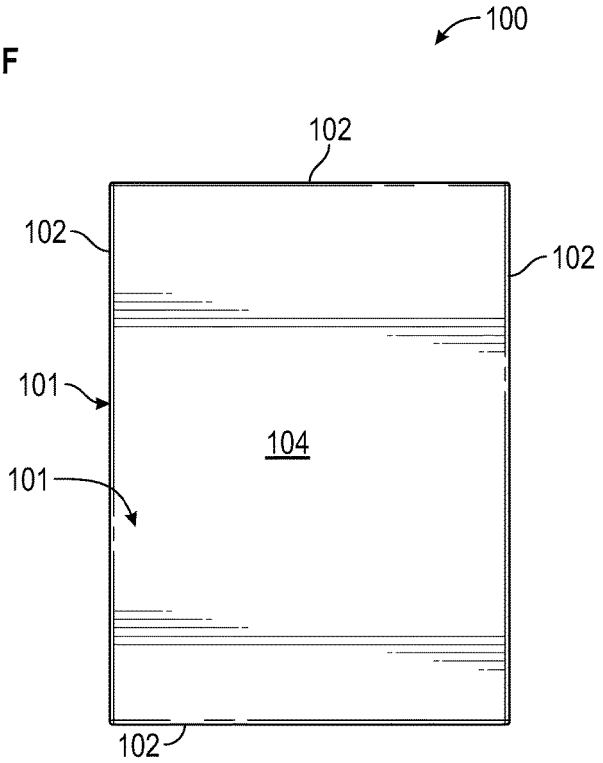
FIG. 1G may depict a bottom view of the carton of FIG. 1A.

FIG. 1A may depict a perspective view of a carton 100, according to one embodiment of the present invention. FIG. 1B may depict a front view of carton 100. FIG. 1C may depict a back view of carton 100. FIG. 1D may depict a left-side view of carton 100. FIG. 1E may depict a right-side view of carton 100. FIG. 1F may depict a top view of carton 100. FIG. 1G may depict a bottom view of carton 100. In some embodiments, exteriorly, carton 100 may comprise exterior-walls 101. In some embodiments, such exterior-walls 101 may substantially bound interior chambers of carton 100.

Continuing discussing FIG. 1A, FIG. 1B, FIG. 1C, FIG. 1D, FIG. 1E, FIG. 1F, and FIG. 1G, in some embodiments, exterior-walls 101 may comprises vertical-walls 102, top-walls 103, and a bottom-wall 104. That is, such exterior-walls 101 may be categorized by their orientation in carton 100. In some embodiments, top-walls 103 may be disposed opposite and away from the bottom-wall 104. In some embodiments, bottom-wall 104 may be attached to vertical-walls 102. In some embodiments, vertical-walls 102 may be attached to top-walls 103. In some embodiments, bottom-wall 104 may be substantially flat and/or planar. In some embodiments, bottom-wall 104 may be configured to allow carton 100, to rest in a substantially vertical orientation upon a given substantially flat and/or planar substrate (e.g., a tabletop, a countertop, a shelf, etc.). In some embodiments, vertical-walls 102 may be side walls of carton 100; such as, exterior side walls.

Continuing discussing FIG. 1A, FIG. 1B, FIG. 1C, FIG. 1D, FIG. 1E, FIG. 1F, and FIG. 1G, in some embodiments, one or more of exterior-walls 101, vertical-walls 102, top-walls 103, and/or bottom-wall 104 may be substantially flat and/or planar.

Continuing discussing FIG. 1A, FIG. 1B, FIG. 1C, FIG. 1D, FIG. 1E, FIG. 1F, and FIG. 1G, in some embodiments, bottom-wall 104 and vertical-walls 102 may be shaped to substantially form a rectangular prism shape. In some embodiments, bottom-wall 104, vertical-walls 102, and top-walls 103 may be shaped to substantially form a traditional pint/quart/half/one-gallon milk carton shape (e.g., where a top portion of the milk carton may have a gable roof type of structure and/or appearance). In some embodiments, top-walls 103 may form a roof of the given carton, such as a roof substantially gable in shape. A highest point/line of carton 100 may be gable-top 105. In some embodiments, gable-top 105 may be disposed opposite from bottom-wall 104.

In some embodiments, exterior-walls 101 may be shaped such that carton 100 may be substantially cylindrical shaped, triangular prism shaped, triangular pyramid, square pyramid, square prism shaped, pentagonal prism shaped, hexagonal prism shaped, octagonal prism shaped, polygon prism shaped, polygon pyramid shaped, spherical shaped, semi-spherical shaped, and the like.

In some embodiments, an exterior cross-section of a width of a given carton may be substantially shaped as a regular polygon. See e.g., FIG. 3A, FIG. 3B, and/or FIG. 3C.

In some embodiments, with respect to a vertical direction of a given carton, from a bottom of the carton to the oppositely disposed roof of the carton, the two chambers may be arranged adjacent to each other, with no gaps between the two chambers; and such that one of the two chambers does not substantially surround the other of the two chambers.

Figure 2A:
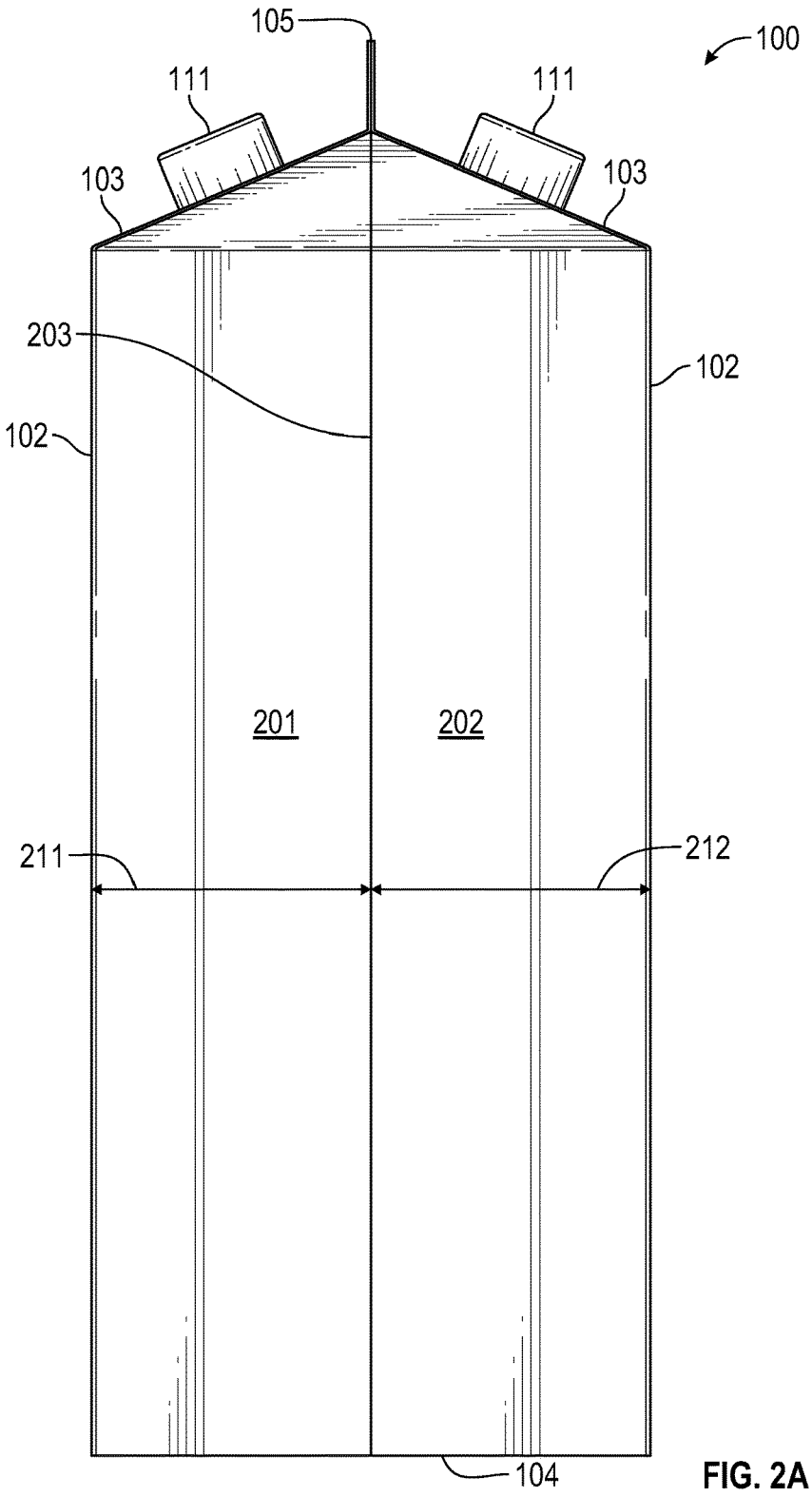
FIG. 2A may depict a longitudinal cross-sectional view of the carton of FIG. 1A, showing two adjoining internal chambers.
Figure 2B:
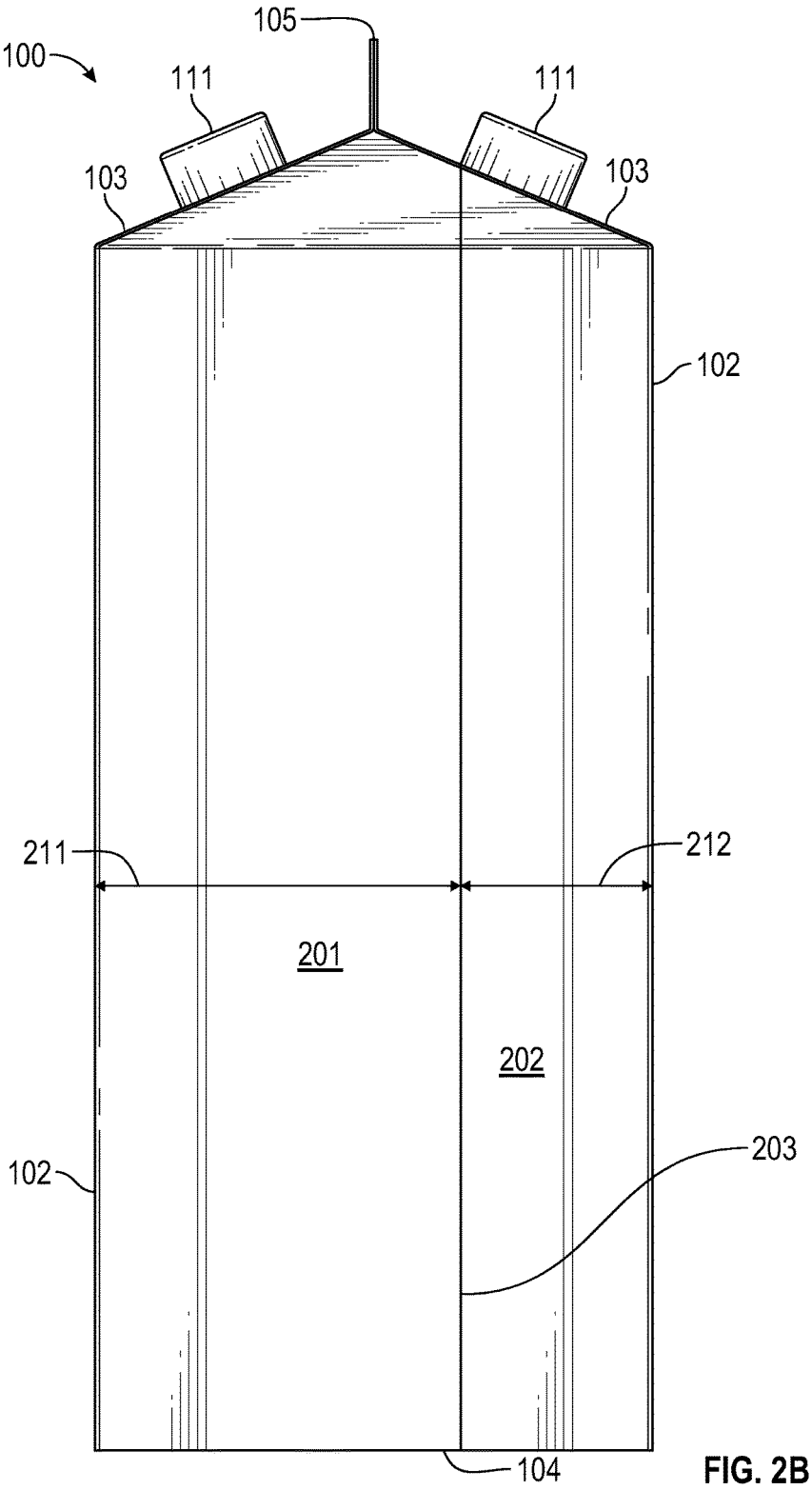
FIG. 2B may depict a longitudinal cross-sectional view of the carton of FIG. 1A, showing two adjoining internal chambers.

FIG. 2A may depict a longitudinal cross-sectional view of carton 100, showing two adjoining internal chambers, a first-chamber 201 and a second-chamber 202. FIG. 2B may depict a longitudinal cross-sectional view of carton 100, showing two adjoining internal chambers, first-chamber 201 and second-chamber 202. FIG. 2A and FIG. 2B may differ from each other, in that the sizes (e.g., volumes) of the respective first-chamber 201 and second-chamber 202 shown may be of different sizes with respect to each other.

For example, and without limiting the scope of the present invention, in FIG. 2A, a volume of first-chamber 201 may be substantially similar to a volume of second-chamber 202.

For example, and without limiting the scope of the present invention, in FIG. 2B, a volume of first-chamber 201 may be larger than a volume of second-chamber 202.

Continuing discussing FIG. 2A and FIG. 2B, in some embodiments, carton 100 may comprise two chambers, first-chamber 201 and second-chamber 202. In some embodiments, first-chamber 201 and second-chamber 202 may share a common-interior-wall 203. In some embodiments, common-interior-wall 203 may be a divider, a barrier, and/or a partition completely separating a volume of first-chamber 201 from a volume of second-chamber 202. In some embodiments, common-interior-wall 203 may prevent contents of first-chamber 201 from mixing with contents of second-chamber 202, while such contents may be removably housed in carton 100. In some embodiments, a bottom of common-interior-wall 203 may attach to bottom-wall 104. In some embodiments, a top of common-interior-wall 203 may attach to top-walls 103. In some embodiments, sides of common-interior-wall 203 may attach to opposing vertical-walls 102. In some embodiments, each chamber (e.g., first-chamber 201 and/or second-chamber 202) may be substantially enclosed by exterior-walls 101 and common-interior-wall 203. In some embodiments, each chamber (e.g., first-chamber 201 and/or second-chamber 202) may be accessible by its own separate and independent spout 411 (see FIG. 4 for spouts 411); such that carton 100 may be dual chambered and dual spouted. In some embodiments, common-interior-wall 203 may be substantially disposed within exterior-walls 101. See e.g., FIG. 2A and FIG. 2B.

Continuing discussing FIG. 2A and FIG. 2B, in some embodiments, first-chamber 201 may comprise a first-chamber-width 211, which may be a width or a depth of first-chamber 201. In some embodiments, second-chamber 202 may comprise a second-chamber-width 212, which may be a width or a depth of second-chamber 202.

In some embodiments, a length of carton 100 may be longer than first-chamber-width 211. In some embodiments, a length of carton 100 may be longer than second-chamber-width 212. In some embodiments, a length of carton 100 may be longer than first-chamber-width 211 plus that of second-chamber-width 212. In some embodiments, in a vertical direction, carton 100 may be elongate; i.e., longer than wide; and longer than deep.

In FIG. 2A, first-chamber-width 211 may be substantially similar, in terms of predetermined dimension, to second-chamber-width 212. In FIG. 2A, a ratio of first-chamber-width 211 to second-chamber-width 212 may be substantially one.

In FIG. 2B, first-chamber-width 211 may be larger than second-chamber-width 212. In FIG. 2B, a ratio of first-chamber-width 211 to second-chamber-width 212 may be greater than one. In some embodiments, the ratio of first-chamber-width 211 to second-chamber-width 212 may be from 1.5 to 3.0.

In some embodiments, exterior-walls 101 and common-interior-wall 203 may be substantially flat and substantially planar. In some embodiments, exterior-walls 101 and common-interior-wall 203 may be substantially rigid to semi-rigid. In some embodiments, exterior-walls 101 and common-interior-wall 203 may not be significantly flexible, not elastic, and not significantly stretchable. In some embodiments, volumes of the first-chamber and the second-chamber may each be substantially predetermined, fixed, and not expandable.

Figure 3A:
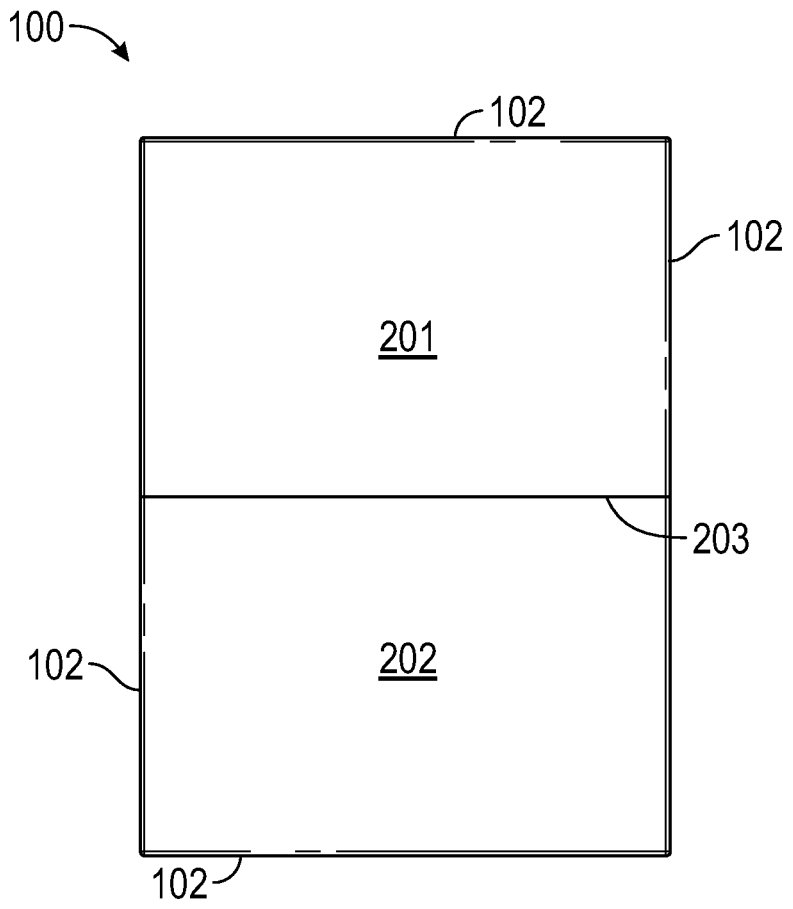
FIG. 3A may depict a transverse width (or depth) cross-sectional view of the carton of FIG. 1A, showing two adjoining internal chambers.
Figure 3B:
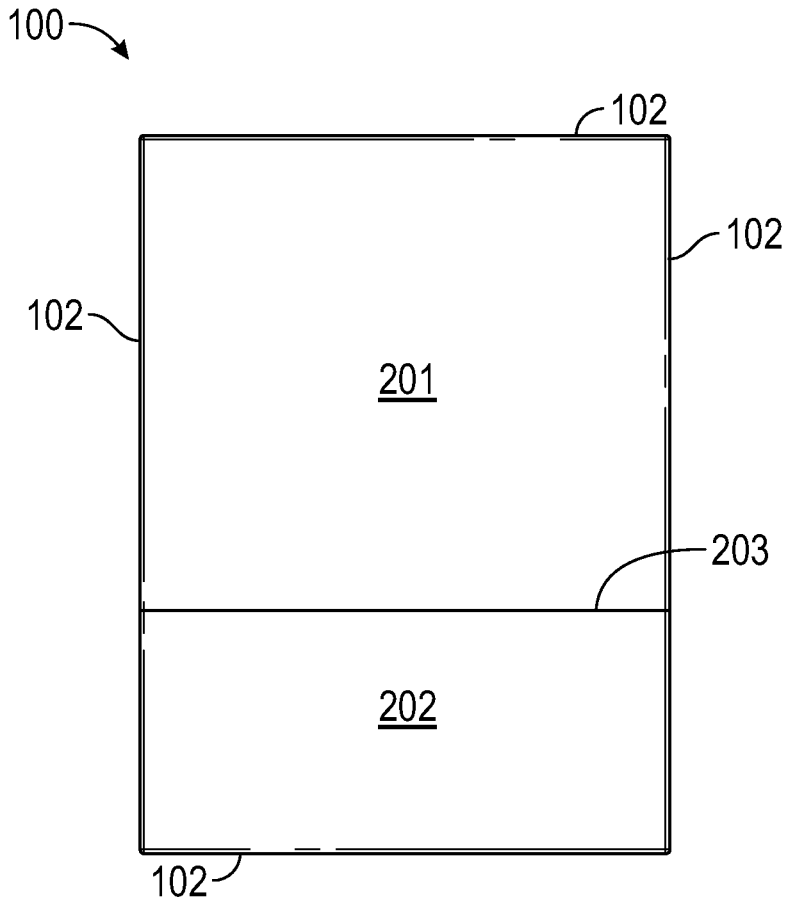
FIG. 3B may depict a transverse width (or depth) cross-sectional view of the carton of FIG. 1A, showing two adjoining internal chambers.

FIG. 3A may depict a transverse width (or depth) cross-sectional view of carton 100, showing two adjoining internal chambers, first-chamber 201 and second-chamber 202. FIG. 3B may depict a transverse width (or depth) cross-sectional view of carton 100, showing two adjoining internal chambers, first-chamber 201 and second-chamber 202. FIG. 3A and FIG. 3B may differ from each other, in that the sizes (e.g., volumes) of the respective first-chamber 201 and second-chamber 202 shown may be of different sizes with respect to each other. FIG. 3A may correspond with FIG. 2A. And FIG. 3B may correspond with FIG. 2B.

Figure 3C:
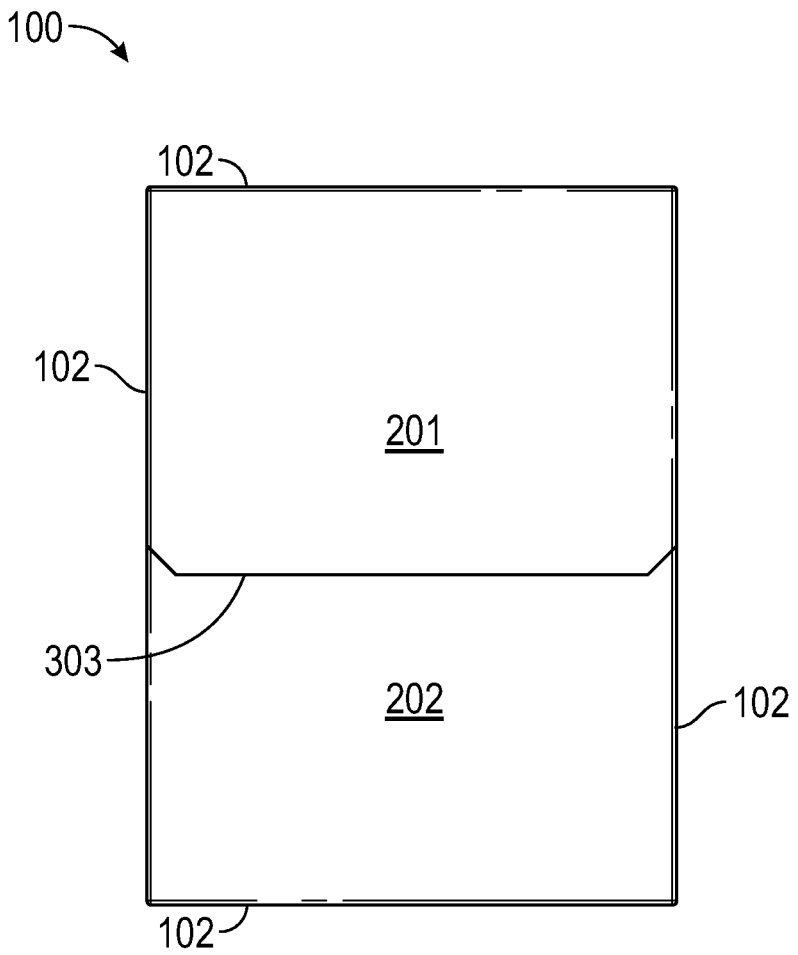
FIG. 3C may depict a transverse width (or depth) cross-sectional view of the carton of FIG. 1A, showing two adjoining internal chambers.

FIG. 3C may depict a transverse width (or depth) cross-sectional view of carton 100, showing two adjoining internal chambers, first-chamber 201 and second-chamber 202. FIG. 3C may differ from FIG. 3A and from FIG. 3B, in that in FIG. 3C, instead of carton 100 comprising common-interior-wall 203, in FIG. 3C, carton 100 may comprise common-interior-wall 303. In some embodiments, common-interior-wall 203 and common-interior-wall 303 may be substantially structurally and functionally equivalent to each other. In some embodiments, common-interior-wall 203 may be substantially flat and planar member; whereas common-interior-wall 303 may have bends; such as, but not limited to, two or more bends. In some embodiments, common-interior-wall 303 may be comprised of three substantially flat and planar portions, joined together with two disposed opposite bends (angles). See e.g., FIG. 3C.

In some embodiments, an overall exterior shape of a given carton may have predetermined dimensional boundaries that may be substantially similar to dimensional boundaries of existing gable topped milk cartons. In some embodiments, an overall exterior shape of a given carton may have predetermined dimensional boundaries that may be substantially similar to dimensional boundaries of existing gable topped juice cartons.

Figure 4:
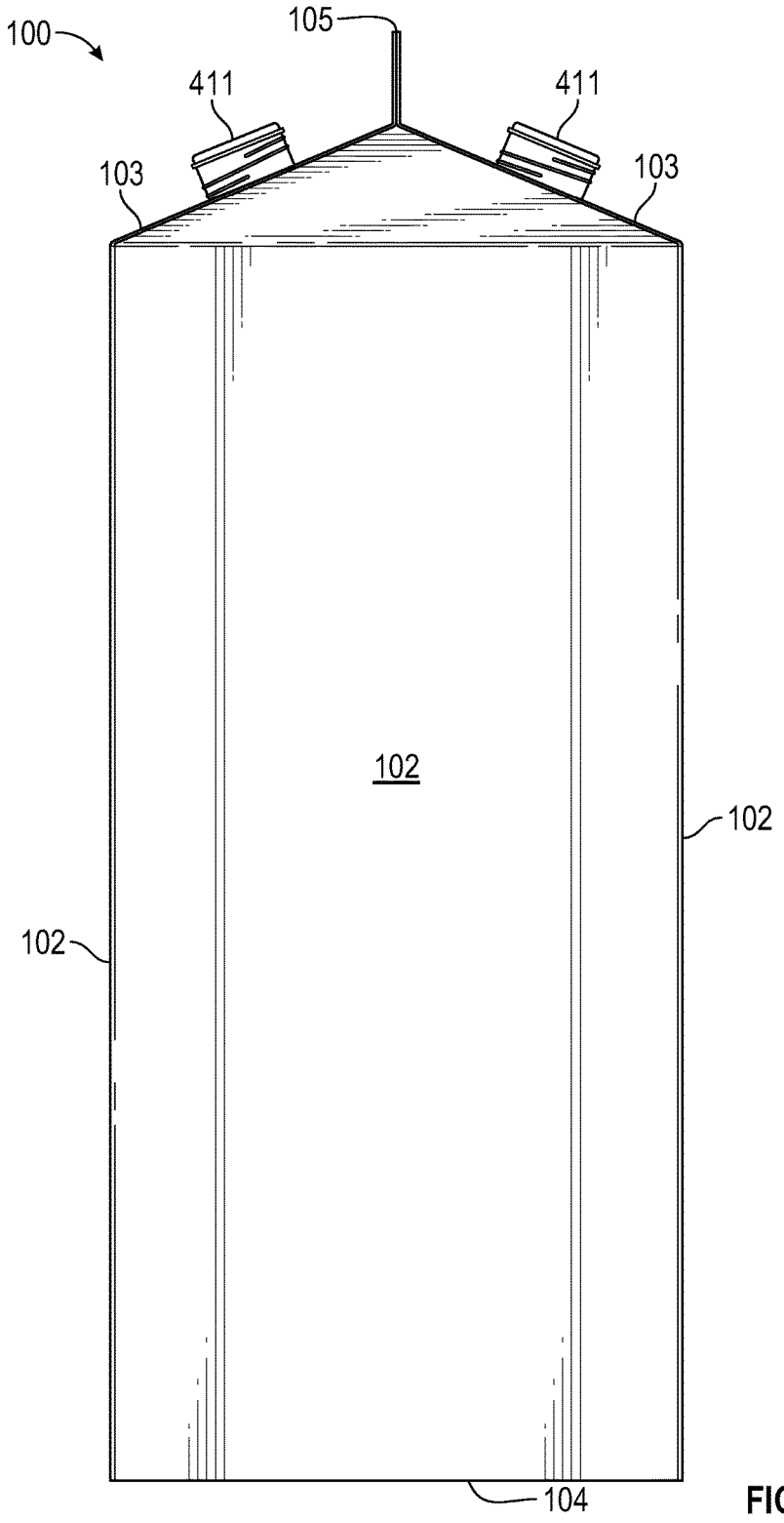
FIG. 4 may depict a left-side view of the carton of FIG. 1A, with lids removed and showing two separate and independent spouts.

FIG. 4 may depict a left-side view of carton 100, with lids 111 removed and showing two separate and independent spouts 411. In some embodiments, each lid 111 may removably couple and seal a given spout 411. See e.g., FIG. 1D for lids 111; and see FIG. 4 for spouts 411. For example, and without limiting the scope of the present invention, a paired lid 111 and spout 411 may have complimentary threading for removable coupling to each other.

In some embodiments, each spout 411 may be located on a given portion of top-wall 103. In some embodiments, each spout 411 may be located substantially symmetrically and/or substantially equidistance from a gable-top 105.

In some embodiments, a spout (e.g., spout 411) for a given chamber (e.g., first-chamber 201 and/or second-chamber 202) may be located on a top (e.g., top-wall 103), side (e.g., vertical-wall 102), or bottom (e.g., bottom-wall 104) of that given chamber.

In some embodiments, each spout 411 of the two chambers may point in a different, but not opposite, direction. Thus, in such embodiments it may not be desirable to open both spouts 411 and try to pour from both spouts 411 simultaneously, as undesirable spillage might occur; rather, it may be more desirable to pour from one given spout 411 at a time. In some embodiments, each spout 411 may be located at substantially a same height with respect to a common bottom of the given carton. In some embodiments, each spout 411 may be located on a different roof structure of the carton. In some embodiments, the spouts 411 of a given carton may be located on an upper portion or top portion of the given carton. See e.g., FIG. 4.

In some embodiments, each chamber (e.g., first-chamber 201 and/or second-chamber 202) may removably hold (and/or store) a given liquid food item (e.g., a given beverage and/or a given liquid flavorant), that may be complimentary to each other and/or often used together close in time.

In some embodiments, each chamber (e.g., first-chamber 201 and/or second-chamber 202) may removably hold (and/or store) a given liquid, such as, but not limited to, a given beverage.

For example, and without limiting the scope of the present invention, first-chamber 201 may removably hold (and/or store) a milk of one type; while second-chamber 202 may removably hold (and/or store) a milk of another type. For example, and without limiting the scope of the present invention, different types of milks may be selected from milk of a given fat content (e.g., 1%, 2%, whole, skim, non-fat, fortified, or the like), and/or milk of a given flavor (e.g., chocolate, strawberry, or the like).

For example, and without limiting the scope of the present invention, first-chamber 201 may removably hold (and/or store) a juice of one type; while second-chamber 202 may removably hold (and/or store) a different juice.

For example, and without limiting the scope of the present invention, first-chamber 201 may removably hold (and/or store) a water of one type; while second-chamber 202 may removably hold (and/or store) a water of a different type (e.g., flavored and/or sparkling).

In some embodiments, each chamber (e.g., first-chamber 201 and/or second-chamber 202) may removably hold (and/or store) a given liquid, such as, but not limited to, a given liquid food item (e.g., beverages, different types of beverages, etc.), a liquid concentrate, and/or the like.

In some embodiments, a size (e.g., a volume) of each chamber (e.g., first-chamber 201 and/or second-chamber 202) may be predetermined according to consumer preferences or consumer purchasing behavior for a given target market. For example, and without limiting the scope of the present invention, a larger first-chamber 201 may removably house a non-flavored milk; while a smaller second-chamber 202 may removably house a flavored milk (e.g., chocolate or strawberry); wherein consumer purchasing behavior shows that more non-flavored milk is purchased compared to the flavored milk, by volume.

In some embodiments, a size (e.g., a volume) of each chamber (e.g., first-chamber 201 and/or second-chamber 202) may be predetermined according to a strength of flavor; wherein the more strongly flavored food item may be removably housed within a smaller chamber (e.g., second-chamber 202); and the less strongly flavored food item may be removably housed within a larger chamber (e.g., first-chamber 201).

In some embodiments, a size (e.g., a volume) of each chamber (e.g., first-chamber 201 and/or second-chamber 202) may total a volume typical of pre-existing milk carton volumes, such as, but not limited to, 8 ounces, a pint, a quart, a half-gallon, and/or the like.

In some embodiments, carton 100 may be used for a method for removably housing (and/or dispensing) a first liquid edible item in first-chamber 201 and for removably housing (and/or dispensing) a second liquid edible item in second-chamber 202. (Note, use of "edible" herein may mean something that may be safely drinkable, e.g., a beverage.)

In some embodiments, carton 500 may appear substantially similar to carton 100 with respect to externally visible structures shared between carton 100 and carton 500. For example, and without limiting the scope of the present invention, carton 500 may comprise exterior-walls 101, vertical-walls 102, top-walls 103, bottom-wall 104, spouts 411, and lids 111 as these structures were discussed above with respect to carton 100. In some embodiments, carton 500 may also further comprise gable-top 105 as this structure was discussed above with respect to carton 100. See e.g., FIG. 5A, FIG. 5B, and FIG. 5C.

However, carton 500 may differ from carton 100 in a shape and/or a size of two internal chambers of carton 500. In some embodiments, in carton 500, first-chamber 201 may be larger-chamber 501. In some embodiments, in carton 500, second-chamber 202 may be smaller-chamber 503. In some embodiments, the designations of "larger" and "smaller" of larger-chamber 501 and smaller-chamber 503, respectively, may be with respect to each other; that is, larger-chamber 501 may be larger by volume than smaller-chamber 503. In some embodiments, carton 500 may comprise two separate but connected chambers of different sized volumes, that of larger-chamber 501 and smaller-chamber 503. In some embodiments, larger-chamber 501 and smaller-chamber 503 are both integral to carton 500. In some embodiments, larger-chamber 501 and smaller-chamber 503 may not be removed from carton 500. In some embodiments, a combined volume of larger-chamber 501 plus smaller-chamber 503 may occupy an external (or total or overall) volume defined by the external structures of carton 500 (e.g., exterior-walls 101, vertical-walls 102, top-walls 103, bottom-wall 104, spouts 411, and lids 111). In some embodiment, each of the two chambers of carton 500 (e.g., larger-chamber 501 and smaller-chamber 503) may have their own respective spout 411 and lid 111, for providing access to the respective internal volume of the given chamber, as was the case for carton 100. In some embodiments, larger-chamber 501 and/or smaller-chamber 503 may removably hold (store) liquids (such as, but not limited to, beverages and/or condiments). In some embodiments, when each respective lid 111 may be properly secured to its complimentary spout 411, any contents (e.g., a first liquid) of one chamber (e.g., larger-chamber 501) may not mix nor come into physical contact with any contents (e.g., a second liquid) of the other chamber (e.g., smaller-chamber 503). See e.g., FIG. 5A, FIG. 5B, and FIG. 5C.

In some embodiments, larger-chamber 501 may be a fixed and predetermined volume. In some embodiments, smaller-chamber 503 may also be a fixed and predetermined volume, but a different volume and a smaller volume as compared to larger-chamber 501. In some embodiments, a ratio of the volume of larger-chamber 501 to the volume of smaller-chamber 503 may be from 8.00 to 1.04. In some embodiments, a ratio of the volume of larger-chamber 501 to the volume of smaller-chamber 503 may be from 10.00 to 1.04. In some embodiments, a ratio of the volume of larger-chamber 501 to the volume of smaller-chamber 503 may be from 20.00 to 1.04.

Figure 5A:
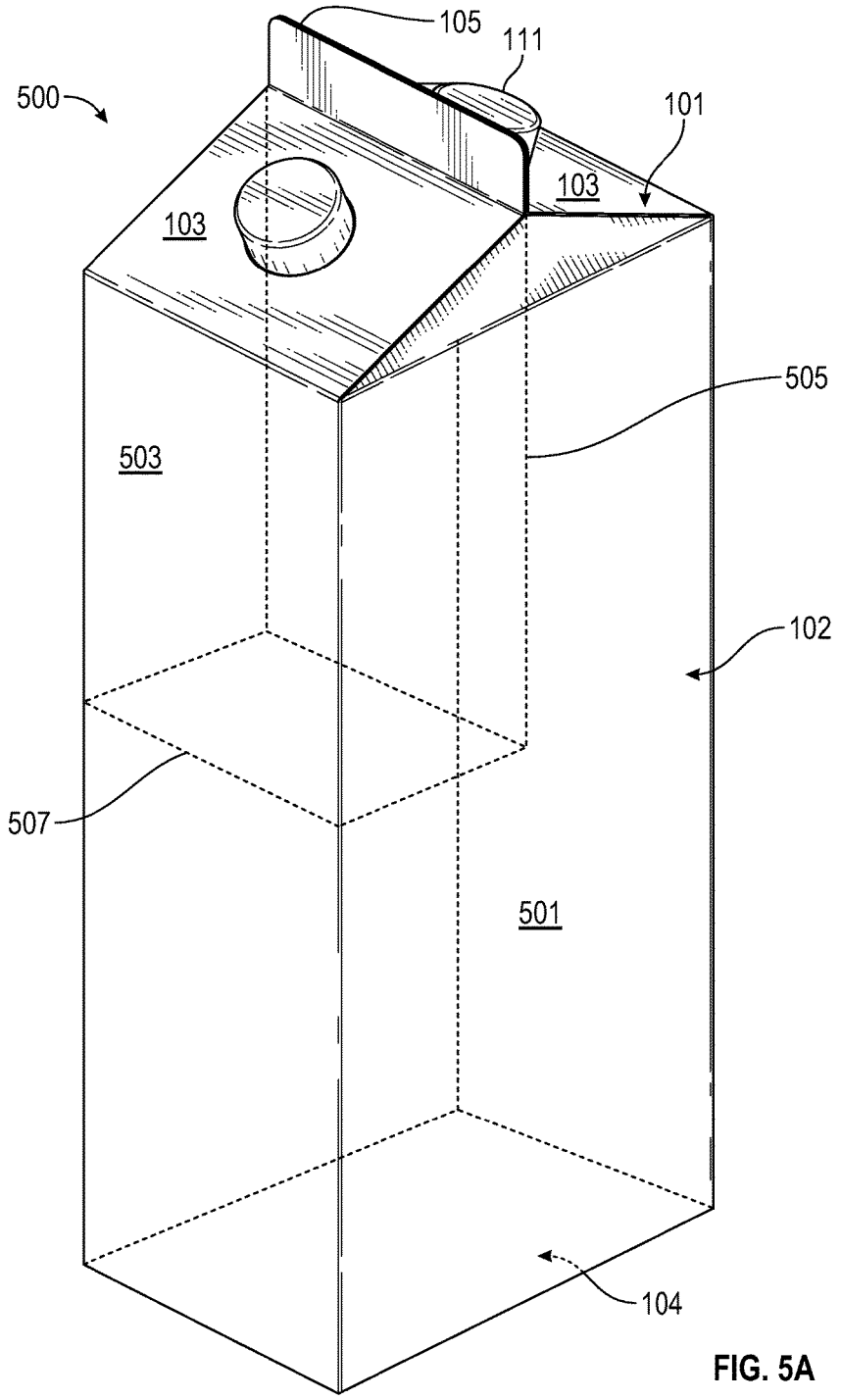
FIG. 5A may depict a carton with two internal adjoining but separate chambers, a larger-chamber and a smaller-chamber, shown from a perspective view and with partial transparency.
Figure 5B:
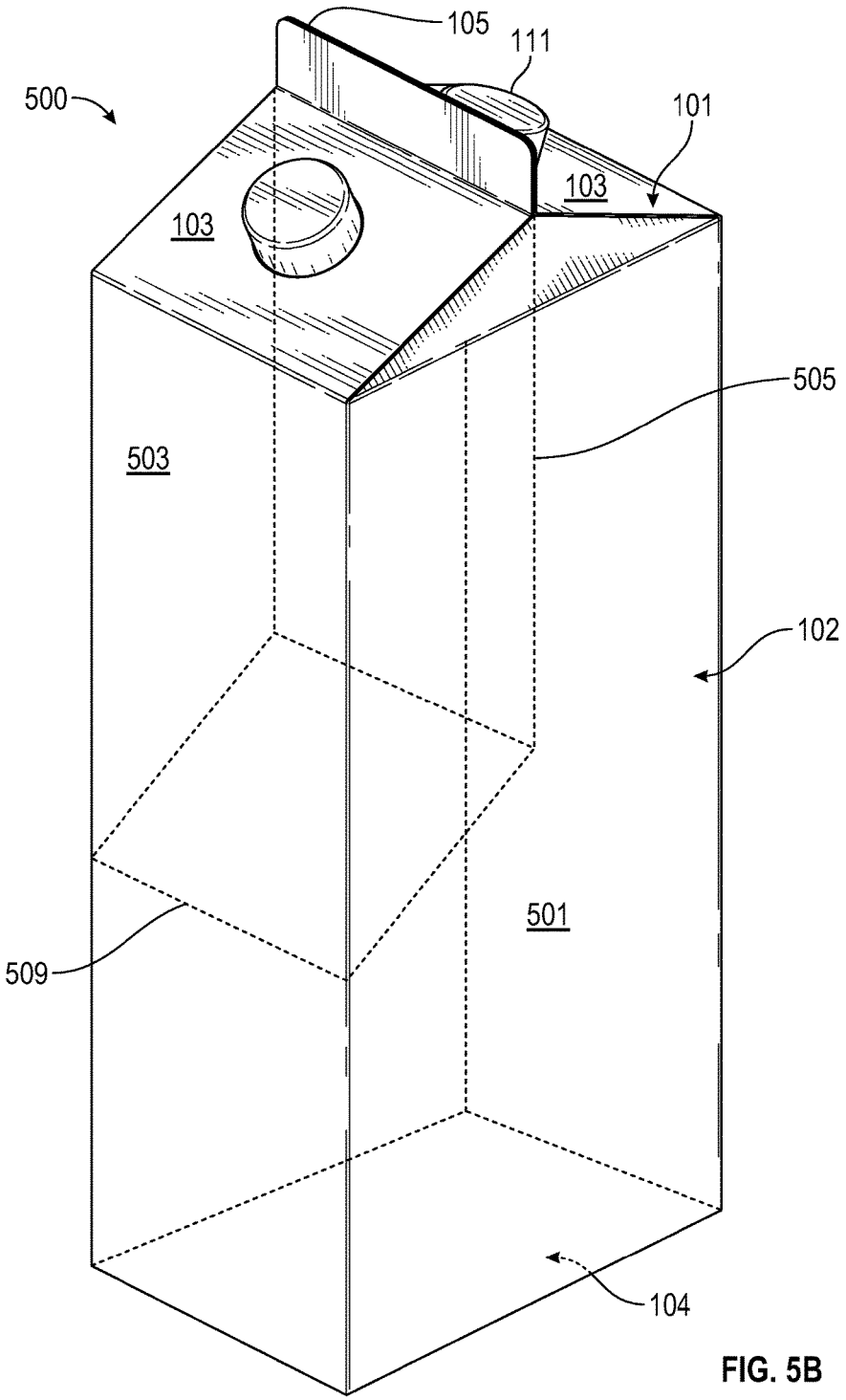
FIG. 5B may depict a carton with two internal adjoining but separate chambers, a larger-chamber and a smaller-chamber, shown from a perspective view and with partial transparency.
Figure 5C:
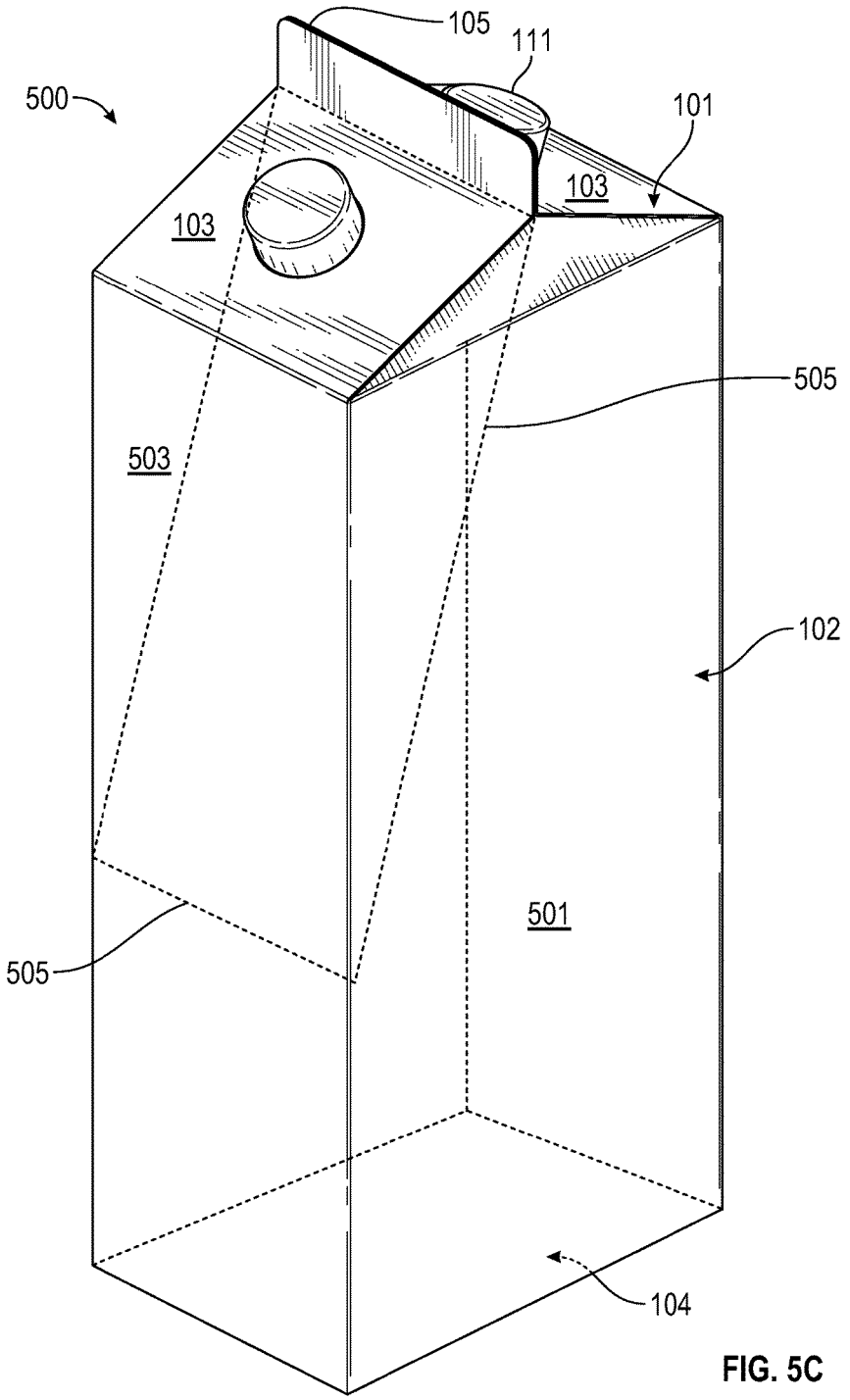
FIG. 5C may depict a carton with two internal adjoining but separate chambers, a larger-chamber and a smaller-chamber, shown from a perspective view and with partial transparency.

As shown in FIG. 5A, FIG. 5B, and FIG. 5C, a shape (three-dimensional shape) of smaller-chamber 503 may differ substantially and/or significantly from a shape (three-dimensional shape) of larger-chamber 501. In some embodiments, the shape of smaller-chamber 503 may be fixed and predetermined. In some embodiments, the shape of larger-chamber 501 may also be fixed and predetermined, but of a different shape as compared to the shape of smaller-chamber 503. As shown in FIG. 5A, FIG. 5B, and FIG. 5C, a bottom of larger-chamber 501 may be bottom-wall 104. Whereas, as shown in FIG. 5A, FIG. 5B, and FIG. 5C, bottom-wall 104 may form no part of smaller-chamber 503. In FIG. 5A and in FIG. 5B, smaller-chamber 503 may have its own bottom separate and different from bottom-wall 104.

In FIG. 5A, smaller-chamber 503 may have smaller-chamber-bottom 507. In some embodiments, smaller-chamber-bottom 507 may be a bottom wall of smaller-chamber 503. In some embodiments, a plane of smaller-chamber-bottom 507 may be substantially parallel with a plane of bottom-wall 104.

In FIG. 5B, smaller-chamber 503 may have smaller-chamber-bottom 509. In some embodiments, smaller-chamber-bottom 509 may be a bottom wall of smaller-chamber 503. In some embodiments, a plane of smaller-chamber-bottom 509 may not be parallel with a plane of bottom-wall 104. In some embodiments, a plane of smaller-chamber-bottom 509 may diverge from a plane of bottom-wall 104 at a fixed none zero angle that may be from 1 degree to 89 degrees, depending upon the given embodiment.

In both FIG. 5A and in FIG. 5B, smaller-chamber 503 may comprise at least two internal wall structures, at least one internal side wall and at least one internal bottom. As noted above, such internal bottoms may be smaller-chamber-bottom 507 or smaller-chamber-bottom 509, respectively. In some embodiments, the internal side wall may be shared-internal-wall 505. In some embodiments, shared-internal-wall 505 may be substantially vertical with respect to bottom-wall 104. In some embodiments, shared-internal-wall 505 may be substantially perpendicular with respect to bottom-wall 104. In some embodiments, shared-internal-wall 505 may run from a top of carton 500 (e.g., from top-wall 103 or from gable-top 105) towards bottom-wall 104, but may not touch bottom-wall 104. See e.g., FIG. 5A and FIG. 5B. Note, shared-internal-wall 505 may have some similarities with common-interior-wall 203 and common-interior-wall 303 of carton 100; except shared-internal-wall 505 may not touch bottom-wall 104.

In some embodiments, smaller-chamber-bottom 507 may be a substantially planar member. In some embodiments, smaller-chamber-bottom 507 may be a substantially flat member. In some embodiments, smaller-chamber-bottom 507 may be a substantially concave. In some embodiments, smaller-chamber-bottom 507 may be a substantially convex.

In some embodiments, smaller-chamber-bottom 509 may be a substantially planar member. In some embodiments, smaller-chamber-bottom 509 may be a substantially flat member. In some embodiments, smaller-chamber-bottom 509 may be a substantially concave. In some embodiments, smaller-chamber-bottom 509 may be a substantially convex.

In some embodiments, shared-internal-wall 505 may be a substantially planar member. In some embodiments, shared-internal-wall 505 may be a substantially flat member. In some embodiments, shared-internal-wall 505 may be a substantially concave. In some embodiments, shared-internal-wall 505 may be a substantially convex.

In both FIG. 5A and in FIG. 5B, shared-internal-wall 505 may also be a shared internal wall with larger-chamber 501. In FIG. 5A, smaller-chamber-bottom 507 may also be a shared internal wall with larger-chamber 501. In FIG. 5B, smaller-chamber-bottom 509 may also be a shared internal wall with larger-chamber 501. See e.g., FIG. 5A and FIG. 5B.

In FIG. 5A, FIG. 5B, and FIG. 5C, smaller-chamber 503 may also be bound by portions of exterior-walls 101, such as portions of vertical-walls 102 and/or portions of top-wall 103. See e.g., FIG. 5A, FIG. 5B, and FIG. 5C.

Discussing FIG. 5C, in some embodiments, shared-internal-wall 505 may not be substantially perpendicular with respect to bottom-wall 104. In some embodiments, shared-internal-wall 505 may run from a top of carton 500 (e.g., from top-wall 103 or from gable-top 105) towards bottom-wall 104 and towards a vertical-wall 102, but may not touch bottom-wall 104. In some embodiments, shared-internal-wall 505 may run from a top of carton 500 (e.g., from top-wall 103 or from gable-top 105) towards bottom-wall 104 and towards a vertical-wall 102, and may physically contact that vertical-wall 102. In some embodiments, shared-internal-wall 505 may run from a top of carton 500 (e.g., from top-wall 103 or from gable-top 105) towards bottom-wall 104 and towards a vertical-wall 102, and may physically connect to and attach to that vertical-wall 102. In some embodiments, smaller-chamber 503 may have one internal wall, that of shared-internal-wall 505. See e.g., FIG. 5C.

Note in some embodiments, smaller-chamber 503 may be a "sample chamber" or "sample container"; wherein use of the word "sample" may refer to intended contents of smaller-chamber 503 being a sample, as in a product sample intended to be sold and marketed with the overall carton 500 to encourage consumers to try this sample. Because external dimensions of carton 500 may be that of standardized beverage cartons, providing a sample to consumers via carton 500 would not require any new infrastructure for shipping and/or storing cartons 500. Thus, existing consumer, retailer, distributor, wholesaler, and manufacturer shelving and/or storage (including refrigerators and cold boxes) may readily accommodate cartons 500, with the integral sample container (smaller-chamber 503).

In some embodiments, carton 500 may be used in a method for marketing and/or distributing a sample liquid edible product by housing the sample edible product within smaller-chamber 503; wherein the smaller-chamber 503 may be in physical contact with larger-chamber 501, wherein the larger-chamber 501 may contain an established liquid edible product; wherein single carton 500 may be formed from both smaller-chamber 503 and larger-chamber 501; wherein larger-chamber 501 may be larger than smaller-chamber 503 by volume; wherein exterior dimensions of carton 500 may be substantially the same as exterior dimensions of a (standardized) container that holds just the established liquid edible product.

In some embodiments, sample liquid edible product may be selected from: different types of beverages; different types of milks (1%, 2%, skim, whole, non-fat, chocolate, strawberry, and the like); different types of juices; different types of liquid food items; different types of liquid concentrates (e.g., which may be added to an existing drink); different types of liquid flavorants; and/or the like.

Advantages to a consumer (or end-user) of such a smaller-chamber 503 being a sample chamber in carton 500, may include:

(a) Ease of opening and ease of use of carton 500, smaller-chamber 503 and larger-chamber 501;

(b) Overall carton 500 does not take any extra or additional storage space as compared to a normal or typical carton without such a smaller-chamber 503;

(c) Provides an opportunity for the consumer to enjoy an extra new product (the sample) that may be housed within smaller-chamber 503; and (d) may provide an opportunity for the consumer to try the extra new product (the sample) without the consumer having to pay for the extra new product.

Advantages to providers, distributors, sellers, of cartons 500 with the smaller-chamber 503 that may be used as a sample chamber may include:

(a) Providing a convenient and cost-effective way to get the sample in front of consumers (e.g., directly into their homes and/or businesses) where the consumer may decide when to try the sample provided in smaller-chamber 503 at their own leisure;

(b) No need to use or rely upon in-store taste testing to promote new products, because now the given sample may be included in each sale of a given carton 500, with the sample housed in smaller-chamber 503;

(c) Eliminates need to manufacture, store, and distribute standalone sample containers that have historically been used to test new products;

(d) Eliminates need for standalone marketing campaigns dedicated to promoting a new product, because now the new product can just be sold to existing customers an already established product (the already existing product is housed in larger-chamber 501 and the new product, the sample, is housed within smaller-chamber 503);

(e) Carton 500 with the two different sized chambers is efficient and cost effective for mass production; and/or (f) A weaker selling product may be housed in smaller-chamber 503 and sold with a popular product housed in larger-chamber 501, thus providing an opportunity to create more interested in the weaker selling product.

Figure 6:
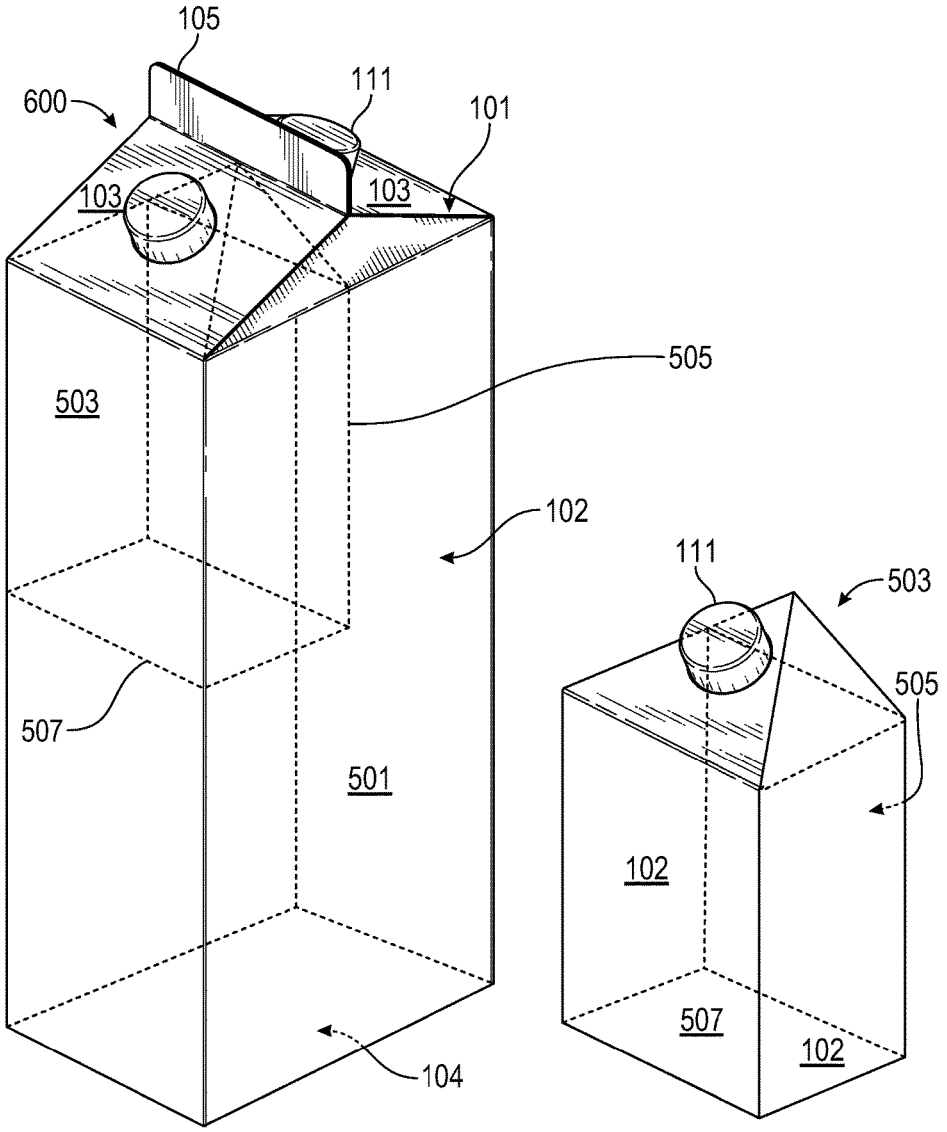
FIG. 6 may depict a carton with two internal adjoining but separate chambers, a larger-chamber and a smaller-chamber, shown from a perspective view and with partial transparency.

FIG. 6 may show a perspective view of a carton 600 with both larger-chamber 501 and smaller-chamber 503; and FIG. 6 may also show smaller-chamber 503 without the remainder of carton 600. FIG. 6 may serve at least two purposes: (1) to show possible structure and geometry of smaller-chamber 503 without showing carton 500 or carton 600; and/or (2) that in some embodiments, smaller-chamber 503 may have a different top shape as compared against top-walls 103 of carton 600.

Discussing FIG. 6, in some embodiments, carton 600 may appear substantially similar to carton 500 with respect to externally visible structures shared between carton 500 and carton 600. For example, and without limiting the scope of the present invention, carton 600 may comprise exterior-walls 101, vertical-walls 102, top-walls 103, bottom-wall 104, spouts 411, and lids 111 as these structures were discussed above with respect to carton 100. In some embodiments, carton 600 may also further comprise gable-top 105 as this structure was discussed above with respect to carton 100. Further, like carton 500, carton 600 may comprise larger-chamber 501 and smaller-chamber 503. Note in FIG. 6, shared-internal-wall 505 is referring to the back vertical wall of smaller-chamber 503. See e.g., FIG. 6.

How carton 600 shown in FIG. 6 may differ from carton 500 is that in some embodiments of carton 600, smaller-chamber 503 may have a different top shape as compared against top-walls 103 of carton 600 (or as compared against top-walls 103 of carton 500). See e.g., FIG. 6.

Figure 7:
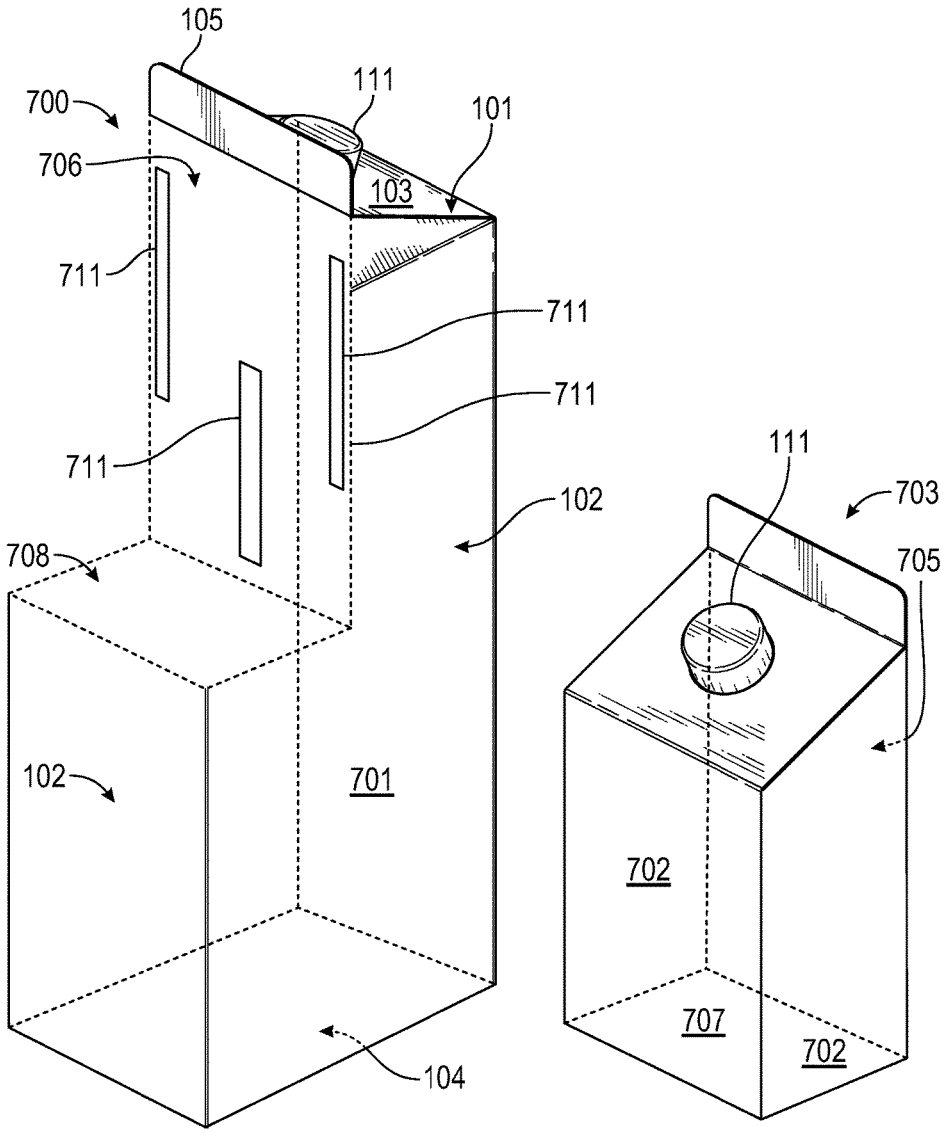
FIG. 7 may depict a carton with two internal adjoining but separate chambers, a larger-chamber and a smaller-chamber, shown from a perspective view and with partial transparency; wherein the smaller-chamber is removable from the larger-chamber.

FIG. 7 may show a perspective view of a carton 700 with both a larger-chamber 701 and a smaller-chamber 703. In some embodiments, carton 700 may appear substantially similar to carton 600 with respect to externally visible structures shared between carton 600 and carton 700. For example, and without limiting the scope of the present invention, carton 700 may comprise exterior-walls 101, vertical-walls 102, top-walls 103, bottom-wall 104, spouts 411, and lids 111 as these structures were discussed above with respect to carton 100. In some embodiments, carton 700 may also further comprise gable-top 105 as this structure was discussed above with respect to carton 100. Further, carton 700 may comprise larger-chamber 701 and smaller-chamber 703. See e.g., FIG. 7.

Discussing FIG. 7, in some embodiments, structurally and functionally, larger-chamber 701 may be substantially similar to larger-chamber 501. In some embodiments, structurally and functionally, smaller-chamber 703 may be substantially similar to smaller-chamber 503. In some embodiments, how carton 700 may differ from carton 600 (and from carton 500), is that smaller-chamber 703 may be removable from larger-volume 701. In some embodiments, smaller-chamber 703 may be removably attached to larger-chamber 701. In some embodiments, smaller-chamber 703 may be removably attached to larger-chamber 701 via fastener(s) 711. In some embodiments, fastener(s) 711 may be a type of mechanical fastener. In some embodiments, fastener(s) 711 may be a Velcro type of fastener, i.e., a plurality of hooks on one surface and a plurality of loops on a complimentary surface intended to be mated with the one surface with the plurality of hooks. In some embodiments, fastener(s) 711 may be tongue and grove type of mechanical sliding fastener, i.e., a tongue on one surface and a groove on a complimentary surface intended to be mated with the one surface with the tongue. These surfaces may be internal-wall 705 and mating-internal-wall 706, respectively. In some embodiments, fastener(s) 711 may be a frictional press fit. Such fasteners 711 are well understood by those of ordinary skill in the relevant art and such fastener disclosures are incorporated herein.

Continuing discussing FIG. 7, in some embodiments, smaller-chamber 703 may bound a substantially fixed and predetermined volume defined by side walls and a bottom. In some embodiments, these side walls may be three vertical-walls 702 and one internal-wall 705 (that may also be a vertical wall and opposing one of the vertical-walls 702). And the bottom wall may be smaller-chamber-bottom 707. Note in FIG. 7, internal-wall 705 is referring to the back vertical wall of smaller-chamber 703. Further note, internal-wall 705 is referred to an internal wall because when smaller-chamber 703 may be removably attached to larger-volume 701, internal-wall 705 is an internal wall in that attached configuration, with respect to overall carton 700. See e.g., FIG. 7.

Continuing discussing FIG. 7, in some embodiments, larger-chamber 701 may bound a substantially fixed and predetermined volume defined by side walls and a bottom. In some embodiments, these side walls may be four vertical-walls 702 and one mating-internal-wall 706 (that may also be a vertical wall and opposing one of the vertical-walls 702). And the bottom wall may be bottom-wall 104. In some embodiments, the volume of larger-chamber 701 may also be bound by a top wall located below mating-internal-wall 706, that of supportive-floor 708. Note, mating-internal-wall 706 is referred to an internal wall because when smaller-chamber 703 may be removably attached to larger-volume 701, mating-internal-wall 706 is an internal wall in that attached configuration, with respect to overall carton 700. Note, mating-internal-wall 706 is referred to a mating wall because when smaller-chamber 703 may be removably attached to larger-volume 701, mating-internal-wall 706 is mated to and/or proximate to internal-wall 705 of smaller-chamber 703. Note, supportive-floor 708 is referred to a supportive floor because when smaller-chamber 703 may be removably attached to larger-volume 701, supportive-floor 708 supports smaller-chamber-bottom 707 of smaller-chamber 703. See e.g., FIG. 7.

Continuing discussing FIG. 7, in some embodiments, structure shared-internal-wall 505 may be replaced with internal-wall 705 and mating-internal-wall 706. In some embodiments, internal-wall 705 and mating-internal-wall 706 may be substantially parallel surfaces when smaller-chamber 703 may be removably attached to larger-chamber 701. In some embodiments, internal-wall 705 and mating-internal-wall 706 may be mating surfaces when smaller-chamber 703 may be removably attached to larger-chamber 701. In some embodiments, internal-wall 705 and mating-internal-wall 706 may be in physical contact with each other when smaller-chamber 703 may be removably attached to larger-chamber 701. Similarly, in some embodiments, structure smaller-chamber-bottom 507 may be replaced with smaller-chamber-bottom 707 and supportive-floor 708. In some embodiments, smaller-chamber-bottom 507 and supportive-floor 708 may be substantially parallel surfaces when smaller-chamber 703 may be removably attached to larger-chamber 701. In some embodiments, smaller-chamber-bottom 507 and supportive-floor 708 may be mating surfaces when smaller-chamber 703 may be removably attached to larger-chamber 701. In some embodiments, smaller-chamber-bottom 507 and supportive-floor 708 may be in physical contact with each other when smaller-chamber 703 may be removably attached to larger-chamber 701. See e.g., FIG. 7.

In some embodiments, fastener(s) 711 may be located on mating-internal-wall 706 and on internal-wall 705, such that mating-internal-wall 706 may be removably attached to internal-wall 705. See e.g., FIG. 7.

In some embodiments, fastener(s) 711 may be located on supportive-floor 708 and on smaller-chamber-bottom 707, such that supportive-floor 708 may be removably attached to smaller-chamber-bottom 707.

In some embodiments, a ratio of the volume of larger-chamber 701 to the volume of smaller-chamber 703 may be as described for larger-chamber 501 and smaller-chamber 503.

In some embodiments, smaller-chamber 703 may be a sample container or sample chamber, similar to smaller-chamber 503.

Figure 8:
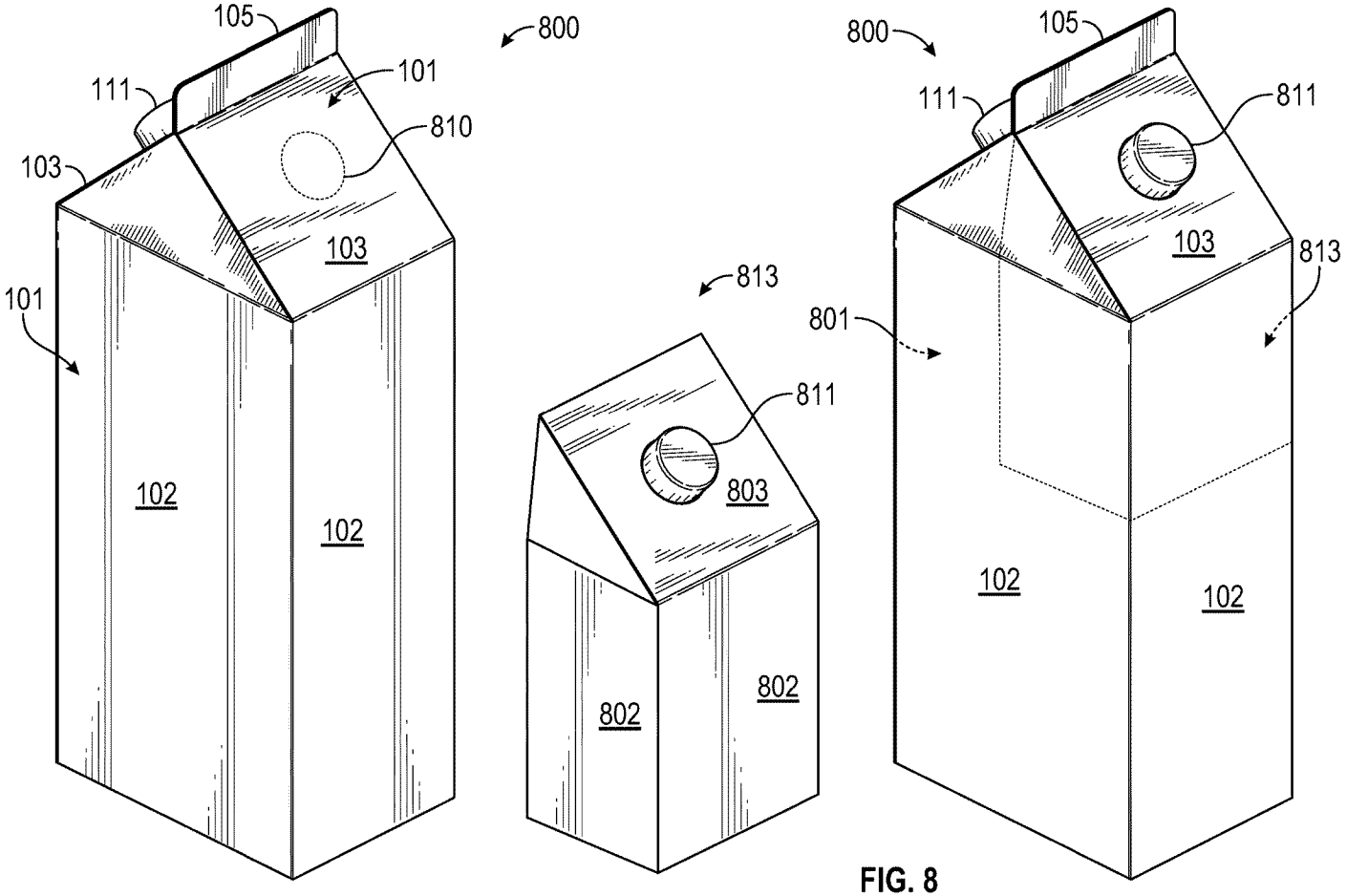
FIG. 8. may depict a carton with two internal adjoining but separate chambers, a larger-chamber and a smaller-chamber, shown from a perspective view and with partial transparency.

FIG. 8 may show a perspective view of a carton 800 with both a larger-chamber 801 and a smaller-chamber 813. In some embodiments, carton 800 may appear substantially similar to carton 100 with respect to externally visible structures shared between carton 100 and carton 800. For example, and without limiting the scope of the present invention, carton 800 may comprise exterior-walls 101, vertical-walls 102, top-walls 103, bottom-wall 104, spouts 411, and lid 111 as these structures were discussed above with respect to carton 100. In some embodiments, carton 800 may also further comprise gable-top 105 as this structure was discussed above with respect to carton 100. See e.g., FIG. 8.

However, carton 800 may differ from carton 100 in a shape and/or a size of two internal chambers of carton 800. In some embodiments, in carton 800, first-chamber 201 may be larger-chamber 801. In some embodiments, in carton 800, second-chamber 202 may be smaller-chamber 813. In some embodiments, the designations of "larger" and "smaller" of larger-chamber 801 and smaller-chamber 813, respectively, may be with respect to each other; that is, larger-chamber 801 may be larger by volume than smaller-chamber 813. In some embodiments, carton 800 may comprise two separate but connected chambers of different sized volumes, that of larger-chamber 801 and smaller-chamber 813. In some embodiments, larger-chamber 801 and smaller-chamber 813 are both integral to carton 800. In some embodiments, larger-chamber 801 and smaller-chamber 813 may not be removed from carton 800. In some embodiments, a combined volume of larger-chamber 801 plus smaller-chamber 813 may occupy an external (or total or overall) volume defined by the external structures of carton 800 (e.g., exterior-walls 101, vertical-walls 102, top-walls 103, bottom-wall 104, spouts 411, and lid 111). In some embodiment, each of the two chambers of carton 800 (e.g., larger-chamber 801 and smaller-chamber 813) may have their own respective spout 411, lid 111 for larger-chamber 801, and lid 811 for smaller-chamber 813, for providing access to the respective internal volume of the given chamber, as was the case for carton 100. In some embodiments, larger-chamber 801 and/or smaller-chamber 813 may removably hold (store) liquids (such as, but not limited to, beverages and/or condiments). In some embodiments, when each respective lid 111 and lid 811 may be properly secured to its complimentary spout 411, any contents (e.g., a first liquid) of one chamber (e.g., larger-chamber 801) may not mix nor come into physical contact with any contents (e.g., a second liquid) of the other chamber (e.g., smaller-chamber 813). See e.g., FIG. 8.

In some embodiments, larger-chamber 801 may be a fixed and predetermined volume. In some embodiments, smaller-chamber 813 may also be a fixed and predetermined volume, but a different volume and a smaller volume as compared to larger-chamber 801. In some embodiments, a ratio of the volume of larger-chamber 801 to the volume of smaller-chamber 813 may be from 8.00 to 1.04. In some embodiments, a ratio of the volume of larger-chamber 801 to the volume of smaller-chamber 813 may be from 10.00 to 1.04. In some embodiments, a ratio of the volume of larger-chamber 801 to the volume of smaller-chamber 813 may be from 20.00 to 1.04.

As shown in FIG. 8, a shape (three-dimensional shape) of smaller-chamber 813 may differ substantially and/or significantly from a shape (three-dimensional shape) of larger-chamber 801. In some embodiments, the shape of smaller-chamber 813 may be fixed and predetermined. In some embodiments, the shape of larger-chamber 801 may also be fixed and predetermined, but of a different shape as compared to the shape of smaller-chamber 813.

In some embodiments, smaller-chamber 813 may be formed from vertical-walls 802, top-wall 803, and a bottom wall (not explicitly shown in FIG. 8, but nonetheless present in FIG. 8). In some embodiments, smaller-chamber 813 may comprise its own lid 811, that is removable from an underlying spout 411, to provide access to the volume of smaller-chamber 813. In some embodiments, top-wall 103 of carton 800 may comprise hole 810. In some embodiments, hole 810 may be sized to accept passage of lid 811 of smaller-chamber 813. In some embodiments, smaller-chamber 813 may fit fixedly within carton 800, with lid 811 protruding from hole 810. See e.g., FIG. 8.

Figure 9:
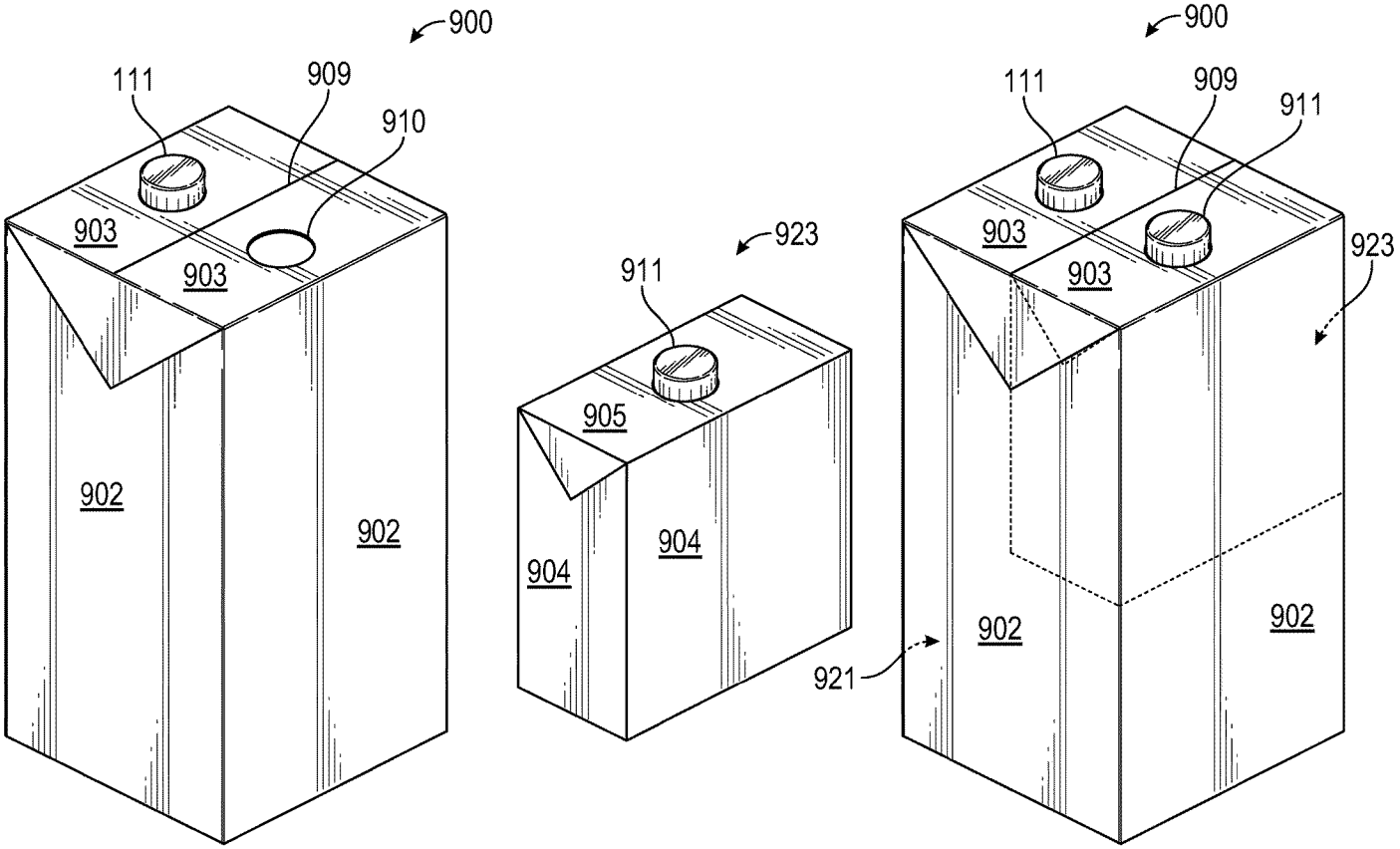
FIG. 9 may show the smaller-chamber without the larger-chamber

FIG. 9 may show a perspective view of a carton 900 with both a larger-chamber 921 and a smaller-chamber 923. In some embodiments, carton 900 may appear substantially similar to carton 800 with respect to externally visible structures shared between carton 900 and carton 100, except carton 900 may not be gabled. In some embodiments, a roof (e.g., top-wall 903) of carton 900 may be substantially flat and substantially parallel with a bottom of carton 900. Aside from roof geometry differences between carton 900 and carton 800, these two cartons may be substantially similar in other structures and in function and purpose. For example, and without limiting the scope of the present invention, carton 900 may comprise two different chambers, a larger-chamber 921 and a smaller-chamber 923, wherein contents of these two chambers do not mix and are maintained separate within carton 900. In some embodiments, larger-chamber 921 may be larger than smaller-chamber 923.

In some embodiments, carton 900 may comprise exterior-walls 901, vertical-walls 902, top-walls 903, bottom-wall (present in FIG. 9 but not shown explicitly), spouts 411, lid 111, and lid 911. In some embodiments, exterior-walls 901 may comprise vertical-walls 902, top-walls 903, bottom-wall (present in FIG. 9 but not shown explicitly). In some embodiments, an exterior of carton 900 may be substantially formed by vertical-walls 902, top-walls 903, and bottom-wall (present in FIG. 9 but not shown explicitly). See e.g., FIG. 9.

In some embodiments, in carton 900, first-chamber 201 may be larger-chamber 921. In some embodiments, in carton 900, second-chamber 202 may be smaller-chamber 923. In some embodiments, the designations of "larger" and "smaller" of larger-chamber 921 and smaller-chamber 923, respectively, may be with respect to each other; that is, larger-chamber 921 may be larger by volume than smaller-chamber 923. In some embodiments, carton 900 may comprise two separate but connected chambers of different sized volumes, that of larger-chamber 921 and smaller-chamber 923. In some embodiments, larger-chamber 921 and smaller-chamber 923 are both integral to carton 900. In some embodiments, larger-chamber 921 and smaller-chamber 923 may not be removed from carton 900. In some embodiments, a combined volume of larger-chamber 921 plus smaller-chamber 923 may occupy an external (or total or overall) volume defined by the external structures of carton 900 (e.g., exterior-walls 901, vertical-walls 902, top-walls 903, the bottom-wall, spouts 411, lid 111, and lid 911). In some embodiment, each of the two chambers of carton 900 (e.g., larger-chamber 921 and smaller-chamber 923) may have their own respective spout 411, lid 111 for larger-chamber 921, and lid 911 for smaller-chamber 923, for providing access to the respective internal volume of the given chamber, as was the case for carton 100. In some embodiments, larger-chamber 921 and/or smaller-chamber 923 may removably hold (store) liquids (such as, but not limited to, beverages and/or condiments). In some embodiments, when each respective lid 111 and lid 911 may be properly secured to its complimentary spout 411, any contents (e.g., a first liquid) of one chamber (e.g., larger-chamber 921) may not mix nor come into physical contact with any contents (e.g., a second liquid) of the other chamber (e.g., smaller-chamber 923). See e.g., FIG. 9.

In some embodiments, larger-chamber 921 may be a fixed and predetermined volume. In some embodiments, smaller-chamber 923 may also be a fixed and predetermined volume, but a different volume and a smaller volume as compared to larger-chamber 921. In some embodiments, a ratio of the volume of larger-chamber 921 to the volume of smaller-chamber 923 may be from 8.00 to 1.04. In some embodiments, a ratio of the volume of larger-chamber 921 to the volume of smaller-chamber 923 may be from 10.00 to 1.04. In some embodiments, a ratio of the volume of larger-chamber 921 to the volume of smaller-chamber 923 may be from 20.00 to 1.04.

As shown in FIG. 9, a shape (three-dimensional shape) of smaller-chamber 923 may differ substantially and/or significantly from a shape (three-dimensional shape) of larger-chamber 921. In some embodiments, the shape of smaller-chamber 923 may be fixed and predetermined. In some embodiments, the shape of larger-chamber 921 may also be fixed and predetermined, but of a different shape as compared to the shape of smaller-chamber 923.

In some embodiments, smaller-chamber 923 may be formed from vertical-walls 904, top-wall 905, and a bottom wall (not explicitly shown in FIG. 9, but nonetheless present in FIG. 9). In some embodiments, smaller-chamber 923 may comprise its own lid 911, that is removable from an underlying spout 411, to provide access to the volume of smaller-chamber 923. In some embodiments, top-wall 903 of carton 900 may comprise hole 910. In some embodiments, hole 910 may be sized to accept passage of lid 911 of smaller-chamber 923. In some embodiments, smaller-chamber 923 may fit fixedly within carton 900, with lid 911 protruding from hole 910. See e.g., FIG. 9.

Also note, in FIG. 9, chambers-vertical-boundary 909 may demark a vertical boundary between larger-chamber 921 and smaller-chamber 923.

Note, in some embodiments, the smaller-chambers shown in FIG. 8 (and in FIG. 9) may not be a mere continuation of the removable smaller-chamber shown in FIG. 7. Rather the depictions of the smaller-chambers (e.g., 813, 923, respectively) shown in FIG. 8 and in FIG. 9 may support the following different embodiments: (1) wherein the given smaller-chamber may be built into its respective larger-chamber as one integral carton, wherein disconnect between the given smaller-chamber and its respective larger-chamber is not intended; (2) wherein the given smaller-chamber may be removable from its respective larger-chamber; or (3) wherein the given smaller-chamber may exist as an insert into its respective larger-chamber.

In some embodiments, a portion of the second-chamber (larger-chamber) may be located beneath the first-chamber (smaller-chamber) with respect to a vertical direction from a bottom of the carton towards a roof of the carton. See e.g., FIG. 5A through FIG. 9.

In some embodiments, walls of carton 100, exterior-walls 101 (e.g., vertical-walls 102, top-walls 103, and bottom-wall 104), common-interior-wall 203, common-interior-wall 303, walls of carton 500, shared-internal-wall 505, smaller-chamber-bottom 507, smaller-chamber-bottom 509, walls of carton 600, walls of carton 700, internal-wall 705, mating-internal-wall 706, smaller-chamber-bottom 707, supportive-floor 708, walls of carton 800, vertical-walls 802, top-walls 803, walls of carton 900, exterior-walls 901 (e.g., vertical-walls 902, top-walls 903, and the bottom-wall of carton 900), vertical-walls 904, and top-walls 905, and chambers-vertical-boundary 909 may be substantially water-proof.

In some embodiments, walls of carton 100, exterior-walls 101 (e.g., vertical-walls 102, top-walls 103, and bottom-wall 104), common-interior-wall 203, common-interior-wall 303, walls of carton 500, shared-internal-wall 505, smaller-chamber-bottom 507, smaller-chamber-bottom 509, walls of carton 600, walls of carton 700, internal-wall 705, mating-internal-wall 706, smaller-chamber-bottom 707, supportive-floor 708, walls of carton 800, vertical-walls 802, top-walls 803, walls of carton 900, exterior-walls 901 (e.g., vertical-walls 902, top-walls 903, and the bottom-wall of carton 900), vertical-walls 904, and top-walls 905, and chambers-vertical-boundary 909 may be substantially constructed from paper and/or paperboard; wherein in some embodiments, the paper and/or the paperboard may be substantially coated, covered, treated, and/or impregnated with one or more hydrophobic waxes and/or plastics, such as, but not limited to polyethylene and/or polypropylene, such that the chambers of carton 100, carton 500, carton 600, carton 700, carton 800 and/or carton 900 may removably house liquids and/or beverages without substantial degradation of: walls of carton 100, exterior-walls 101 (e.g., vertical-walls 102, top-walls 103, and bottom-wall 104), common-interior-wall 203, common-interior-wall 303, walls of carton 500, shared-internal-wall 505, smaller-chamber-bottom 507, smaller-chamber-bottom 509, walls of carton 600, walls of carton 700, internal-wall 705, mating-internal-wall 706, smaller-chamber-bottom 707, supportive-floor 708, walls of carton 800, vertical-walls 802, top-walls 803, walls of carton 900, exterior-walls 901 (e.g., vertical-walls 902, top-walls 903, and the bottom-wall of carton 900), vertical-walls 904, and top-walls 905, and chambers-vertical-boundary 909.

In some embodiments, walls of carton 100, exterior-walls 101 (e.g., vertical-walls 102, top-walls 103, and bottom-wall 104), common-interior-wall 203, common-interior-wall 303, walls of carton 500, shared-internal-wall 505, smaller-chamber-bottom 507, smaller-chamber-bottom 509, walls of carton 600, walls of carton 700, internal-wall 705, mating-internal-wall 706, smaller-chamber-bottom 707, supportive-floor 708, walls of carton 800, vertical-walls 802, top-walls 803, walls of carton 900, exterior-walls 901 (e.g., vertical-walls 902, top-walls 903, and the bottom-wall of carton 900), vertical-walls 904, and top-walls 905, and chambers-vertical-boundary 909 may be substantially constructed from plastic, glass, metal, ceramic, clay, stoneware, wood, and/or combinations thereof; such that the chambers of carton 100, carton 500, carton 600, carton 700, carton 800, and/or carton 900 may removably house liquids and/or beverages without substantial degradation of: walls of carton 100, exterior-walls 101 (e.g., vertical-walls 102, top-walls 103, and bottom-wall 104), common-interior-wall 203, common-interior-wall 303, walls of carton 500, shared-internal-wall 505, smaller-chamber-bottom 507, smaller-chamber-bottom 509, walls of carton 600, walls of carton 700, internal-wall 705, mating-internal-wall 706, smaller-chamber-bottom 707, supportive-floor 708, walls of carton 800, vertical-walls 802, top-walls 803, walls of carton 900, exterior-walls 901 (e.g., vertical-walls 902, top-walls 903, and the bottom-wall of carton 900), vertical-walls 904, and top-walls 905, and chambers-vertical-boundary 909.

Note with respect to the materials of construction, it is not desired nor intended to thereby unnecessarily limit the present invention by reason of such disclosure.

In some embodiments, a volume of the two chambers of a given carton 100, carton 500, carton 600, carton 700, carton 800, and/or carton 900 may be from 1% to 50% of the overall total volume of the given carton 100, carton 500, carton 600, carton 700, carton 800, and/or carton 900.

In some embodiments, a volume of one of the two chambers of a given carton 500, carton 600, carton 700, carton 800, and/or carton 900 may be from 1% to 49% of the overall total volume of the given carton 500, carton 600, carton 700, carton 800, and/or carton 900.

In some embodiments, a size and external dimensions of carton 100, carton 500, carton 600, carton 700, carton 800, and/or carton 900 may be standardized with respect to standard sizes of beverage cartons that may be predominantly present in a given marketplace.

In some embodiments, a size and external dimensions of carton 100, carton 500, carton 600, carton 700, carton 800, and/or carton 900 may be standardized with respect to standard sizes of beverage cartons that may be predominantly present in a given marketplace, such that such cartons carton 100, carton 500, carton 600, carton 700, carton 800, and/or carton 900 may fit into and/or on the shelving and/or packaging of the standardized beverage carton.

For example, and without limiting the scope of the present invention, carton 100, carton 500, carton 600, carton 700, carton 800, and/or carton 900 may be a standard sized one gallon carton, half gallon carton, 40 ounce (oz) carton, 48 oz carton, 52 oz carton, 59 oz carton, one quart carton, 6 oz carton, 8 oz carton, 14 oz carton, 16 oz carton, 20 oz carton, 24 oz carton, 32 oz carton, 4 oz carton, 6 oz carton 8 oz carton, 10 oz carton, one pint carton, 2 liter carton, 250 milliliter (mL) carton, 500 mL carton, 750 mL carton, 1000 mL carton, and/or the like with respect to external dimensions of the given carton.

In some embodiments, a size and external dimensions of carton 100, carton 500, carton 600, carton 700, carton 800, and/or carton 900 may be non-standardized with respect to standard sizes of beverage cartons that may be predominantly present in a given marketplace. In some embodiments, a size and external dimensions of carton 100, carton 500, carton 600, carton 700, carton 800, and/or carton 900 may be predetermined and custom sized.

Various cartons, particularly, dual spouted and dual chambered cartons, have been described. The foregoing description of various embodiments of the invention has been presented for the purposes of illustration and disclosure. It is not intended to be exhaustive or to limit the invention to the precise form disclosed. Many modifications and variations are possible in light of the above teaching without departing from the spirit of the invention.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A carton comprising:

two chambers, a larger-chamber and a smaller-chamber, wherein the smaller-chamber comprises a smaller-chamber-bottom that is a bottom wall of the smaller-chamber;

wherein the larger-chamber and the smaller-chamber share a shared-interior-wall and the shared-interior-wall along with the smaller-chamber-wall that divides the larger-chamber from the smaller-chamber, such that contents of the two chambers are kept isolated from each other;

wherein each of the two chambers is substantially enclosed by exterior-walls of the carton, the shared-interior-wall of the carton, and the smaller-chamber-bottom; wherein the exterior walls comprise a bottom-wall of the carton;

wherein a portion of the larger-chamber is located beneath the smaller-chamber with respect to a vertical direction from the bottom-wall of the carton towards a roof of the carton, with the bottom-wall located beneath the smaller-chamber, and wherein the smaller-chamber is not contacting the bottom-wall of the carton;

wherein each of the two chambers is accessible by its own separate and independent spout; such that the carton is dual chambered and dual spouted.

2. The carton according to claim 1, wherein the shared-interior-wall is substantially disposed within the exterior-walls.

3. The carton according to claim 1, wherein the exterior-walls comprises vertical-walls, top-walls, and the bottom-wall; wherein the top-walls are disposed opposite and away from the bottom-wall; wherein the top-walls form the roof of the carton; wherein the bottom-wall is attached to the vertical-walls; and wherein the vertical-walls are attached to the top-walls.

4. The carton according to claim 3, wherein the bottom-wall and the vertical-walls are shaped to substantially form a rectangular prism shape.

5. The carton according to claim 3, wherein the roof of the carton is substantially gable shaped.

6. The carton according to claim 1, wherein the smaller-chamber-bottom and the bottom-wall of the carton are substantially parallel.

7. The carton according to claim 1, wherein a volume of the larger-chamber is larger than a volume of the smaller-chamber.

8. The carton according to claim 1, wherein each spout of the two chambers points in a different, but not opposite, direction.

9. The carton according to claim 1, wherein each spout is located at substantially a same height with respect to the bottom-wall of the carton.

10. The carton according to claim 1, wherein each spout is located on a different roof structure of the carton.

11. The carton according to claim 1, with respect to the vertical direction of the carton, the two chambers are arranged adjacent to each other, with no gaps between the two chambers; and such that a volume of the larger-chamber does not substantially surround the smaller-chamber.

12. The carton according to claim 1, wherein the exterior-walls and the shared-interior-wall are substantially flat and substantially planar.

13. The carton according to claim 1, wherein the exterior-walls and the shared-interior-wall are substantially rigid to semi-rigid.

14. The carton according to claim 1, wherein an overall exterior shape of the carton has predetermined dimensional boundaries that are substantially similar to dimensional boundaries of existing gable topped milk cartons.

15. The carton according to claim 1, wherein volumes of the larger-chamber and of the smaller-chamber are each substantially predetermined, fixed, and not expandable.

16. The carton according to claim 1, wherein an exterior cross-section of a width of the carton is substantially shaped as a regular polygon.

17. The carton according to claim 1, wherein the smaller-chamber-bottom and the bottom-wall of the carton are not parallel.

18. The carton according to claim 1, wherein the larger-chamber is removably attachable to the smaller-chamber via a mechanical fastener disposed on a portion of a mating-internal-wall that is a portion of the shared-internal-wall.

* * * * *